US008216755B2

(12) United States Patent
Ishikawa et al.

(10) Patent No.: US 8,216,755 B2
(45) Date of Patent: Jul. 10, 2012

(54) TONER, DEVELOPER, TONER CONTAINER, PROCESS CARTRIDGE, IMAGE FORMING APPARATUS, AND IMAGE FORMING METHOD

(75) Inventors: Yoshimichi Ishikawa, Itami (JP); Chiyoshi Nozaki, Otsu (JP); Tsuyoshi Nozaki, Ikeda (JP); Takuya Kadota, Kobe (JP); Katsunori Kurose, Takarazuka (JP); Mitsuyo Matsumoto, Ibaraki (JP); Atsushi Yamamoto, Kawanishi (JP)

(73) Assignee: Ricoh Company, Limited, Tokyo (JP)

( * ) Notice: Subject to any disclaimer, the term of this patent is extended or adjusted under 35 U.S.C. 154(b) by 563 days.

(21) Appl. No.: 12/475,658

(22) Filed: Jun. 1, 2009

(65) Prior Publication Data

US 2009/0297975 A1 Dec. 3, 2009

(30) Foreign Application Priority Data

May 30, 2008 (JP) ..... 2008-141879

(51) Int. Cl.
*G03G 9/08* (2006.01)

(52) U.S. Cl. ..... 430/108.1; 430/108.4

(58) Field of Classification Search ..... 430/108.1, 430/108.4
See application file for complete search history.

(56) References Cited

U.S. PATENT DOCUMENTS

| | | | | |
|---|---|---|---|---|
| 2006/0093934 | A1* | 5/2006 | Roberts et al. | 430/108.1 |
| 2006/0093945 | A1* | 5/2006 | Dalzell et al. | 430/109.1 |
| 2006/0204882 | A1 | 9/2006 | Nozaki et al. | |
| 2006/0210902 | A1 | 9/2006 | Nakamura et al. | |
| 2006/0275686 | A1 | 12/2006 | Kadota et al. | |
| 2007/0026335 | A1 | 2/2007 | Yamamoto et al. | |
| 2007/0059625 | A1 | 3/2007 | Yamamoto et al. | |
| 2007/0166635 | A1 | 7/2007 | Yamamoto et al. | |
| 2007/0190442 | A1 | 8/2007 | Nakamura et al. | |
| 2007/0207399 | A1 | 9/2007 | Kadota et al. | |
| 2007/0218384 | A1 | 9/2007 | Matsumoto et al. | |
| 2007/0218388 | A1 | 9/2007 | Kurose et al. | |
| 2007/0218393 | A1 | 9/2007 | Nozaki et al. | |
| 2007/0238042 | A1 | 10/2007 | Yasunaga et al. | |
| 2008/0038656 | A1 | 2/2008 | Yasunaga et al. | |
| 2008/0069617 | A1 | 3/2008 | Matsumoto et al. | |
| 2008/0096116 | A1* | 4/2008 | Utsumi et al. | 430/48 |
| 2008/0131797 | A1 | 6/2008 | Ishikawa et al. | |
| 2008/0176159 | A1 | 7/2008 | Matsumoto et al. | |
| 2008/0232857 | A1 | 9/2008 | Matsumoto et al. | |

FOREIGN PATENT DOCUMENTS

| | | |
|---|---|---|
| JP | 7-52306 | 6/1995 |
| JP | 2765379 | 4/1998 |
| JP | 2889497 | 2/1999 |
| JP | 3195362 | 6/2001 |
| JP | 3873699 | 11/2006 |
| JP | 2007-34156 | 2/2007 |
| JP | 3994697 | 8/2007 |
| JP | 2009-69536 | 4/2009 |

* cited by examiner

*Primary Examiner* — Hoa V Le

(74) *Attorney, Agent, or Firm* — Oblon, Spivak, McClelland, Maier & Neustadt, L.L.P.

(57) ABSTRACT

A toner manufactured by a method including the steps of dissolving or dispersing toner components comprising a binder resin, a colorant, and an encapsulated plasticizer to prepare an oily toner components liquid, and emulsifying or dispersing the oily toner components liquid in an aqueous medium to prepare the toner.

19 Claims, 3 Drawing Sheets

TONER, DEVELOPER, TONER CONTAINER, PROCESS CARTRIDGE, IMAGE FORMING APPARATUS, AND IMAGE FORMING METHOD

BACKGROUND OF THE INVENTION

1. Field of the Invention

The present invention relates to a toner for developing electrostatic images used for copier, printers, and facsimile machines. The present invention also relates to a developer, a toner container, a process cartridge, an image forming apparatus, and an image forming method using the toner.

2. Discussion of the Background

As methods of fixing toner on a recoding sheet, contact-heating fixing methods such as methods using a heating roller (hereinafter "heating roller fixing methods") are widely employed. Typically, fixing devices employing heating roller fixing methods contain a heating roller and a pressing roller. Recording sheets having toner images thereon are passed through a nip formed between the heating roller and the pressing roller so that the toner melts and is fixed on the recording sheet.

In contact-heating fixing methods such as heating roller fixing methods described above, a toner image on a recording sheet may directly contact a surface of a heating member (such as the heating roller) of a fixing device. Therefore, a part of the toner image may adhere to the heating member and may be re-transferred onto an undesired portion of a next recording sheet. This phenomenon is hereinafter referred to as "offset phenomenon".

To prevent the occurrence of offset phenomenon, one proposed approach involves coating or impregnating heating and pressing rollers with oils such as silicone oils. However, this approach disadvantageously causes upsizing of fixing devices and cost increase due to provision of an oil applicator. In view of such a situation, fixing devices containing no oil applicator or requiring lower amounts of oils are employed recently. Such fixing devices typically use toners containing a releasing agent that serves as an offset inhibitor.

From the viewpoint of energy saving, the heating temperature of the heating member is preferably set as low as possible. Accordingly, thermal properties of binder resins composing toners are preferably as low as possible so that the binder resins can melt at lower temperatures. However, if thermal properties of binder resins are too low, heat-resistant storage stability may deteriorate, which may case toner blocking. Polyester resins, which typically have lower viscosity and higher elasticity compared to vinyl copolymer resins, are advantageously used for binder resins because they melt at lower temperatures and have good heat-resistant storage stability.

When a toner containing a sufficient amount of a release agent is produced by a conventional pulverization method, the release agent tends to expose at surfaces of resultant toner particles. As a result, toner blocking or a filming problem in which undesired toner films are formed on image forming members may occur. On the other hand, such a toner can be produced by polymerization methods such as a suspension polymerization method in which a polymerizable monomer is subjected to a polymerization in an aqueous medium to form toner particles and an emulsion aggregation method in which fine particles formed by an emulsion polymerization are aggregated to form toner particles. Polymerization methods are typically capable of including greater amounts of release agents in resultant toners compared to pulverization methods. Japanese Patent No. 3195362 discloses a suspension polymerization toner, the configuration of which is controlled. Specifically, toner particles formed by a normal suspension polymerization are subsequently subjected to an extra polymerization with additional monomers. Japanese Patent No. 3994697 discloses an emulsion aggregation toner, the configuration of which is also controlled. Specifically, toner particles formed by a normal aggregation are subsequently subjected to an extra aggregation with additional emulsion polymerization particles. These toners are composed of vinyl copolymer resins because both suspension polymerization methods and emulsion aggregation methods are capable of forming vinyl copolymer resins in an aqueous medium. Unlike vinyl copolymer resins, polyester resins are difficult to be formed by either suspension polymerization method or emulsion aggregation method because they are typically polymerized at a high temperature of 200° C.

One possible toner manufacturing method to use polyester resins is a so-called dissolution suspension method in which toner components including a resin are dissolved in an organic solvent and the resultant toner components solution is subjected to granulation in an aqueous medium. Because the resin is never subjected to polymerization in this method, the molecular weight of the resultant toner equals to that of the raw-material resin. Therefore, if thermal properties of the resultant toner need controlling, a low-molecular-weight resin and a high-molecular-weight resin may be mixed in the toner components solution in advance. However, if the amount of the high-molecular-weight resin is too large, the toner components solution may have too large a viscosity, resulting in deterioration of granulation efficiency. Accordingly, the amount of the high-molecular-weight resin is preferably minimized. Instead, the molecular weight of the low-molecular-weight resin needs to increase to some extent, which is disadvantageous for fixing the resultant toner at low temperatures.

To solve this problem, one proposed approach involves elongating and/or cross-linking a modified polyester which has a reactive group after granulation of toner particles, instead of mixing a high-molecular-weight resin in raw materials, to control the molecular weight of the resultant toner. This approach has an advantage in controlling thermal properties of toner, but has a disadvantage in controlling the structure of toner.

As described above, most of recent electrophotographic image forming apparatuses use toners containing a release agent such as a wax. Toners are generally required to express an appropriate gloss when formed into images. It is known that human eyes have a preferable range of gloss. In a case in which the gloss is beyond the preferable range, we may feel uncomfortable sensation, especially when the image is in full-color.

Waxes make a great effect on the gloss of resultant toner images. The greater the amount of wax in toner, the lower the resultant image gloss, and vice versa. This is because waxes in the resultant images cause diffuse reflection of light. Since the gloss is generated based on regular reflection of light, increase of diffuse reflection reduces regular reflection, resulting in deterioration of the gloss. In a case in which the amount of wax in toner is unstable, the gloss may be unstable as well.

In pulverization methods, undesired ultra-fine particles are produced at a time a raw material mixture is pulverized. This is because the raw material mixture easily splits from interfaces of waxes and resins. Therefore, the ultra-fine particles generally include a large amount of wax, but the amount of wax varies depending on production lot of toner. As a result, the gloss of the resultant image varies depending on production lot of toner as well, which causes unreliable image forming.

Accordingly, with regard to toners containing a binder resin and a release agent (such as a wax), no toner is provided which can reliably form high-gloss images.

SUMMARY OF THE INVENTION

Accordingly, an object of the present invention is to provide a toner and a developer which can be fixed at low temperatures, has heat-resistant storage stability and a resistant to offset phenomenon, and does not contaminate developing device.

Another object of the present invention is to provide a toner container, a process cartridge, an image forming apparatus, and an image forming method which can reliably produce high-gloss images.

These and other objects of the present invention, either individually or in combinations thereof, as hereinafter will become more readily apparent can be attained by a toner manufactured by a method comprising;

dissolving or dispersing toner components comprising a binder resin, a colorant, and an encapsulated plasticizer to prepare an oily toner components liquid; and emulsifying or dispersing the oily toner components liquid in an aqueous medium to prepare the toner.

BRIEF DESCRIPTION OF THE DRAWINGS

These and other objects, features and advantages of the present invention will become apparent upon consideration of the following description of the preferred embodiments of the present invention taken in conjunction with the accompanying drawings, wherein.

DETAILED DESCRIPTION OF THE INVENTION

Figure 1:
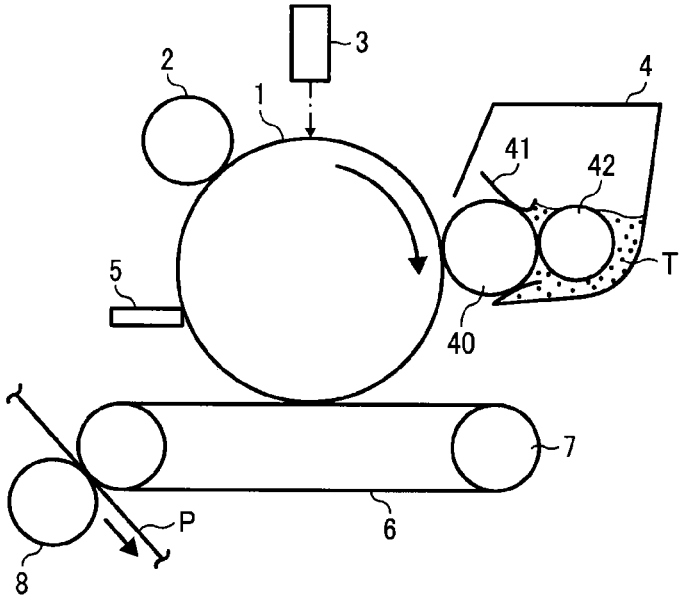
FIG. 1 is a schematic view illustrating an embodiment of an image forming apparatus according to the present invention.

Generally, the present invention provides a toner manufactured by dissolving or dispersing toner components comprising a binder resin, a colorant, and an encapsulated plasticizer to prepare an oily toner components liquid, and emulsifying or dispersing the oily toner components liquid in an aqueous medium to prepare the toner.

The toner components substantially include a binder resin, a colorant, a colorant master batch, a release agent, a release agent disperser, a charge controlling agent, and the like.

The plasticizer is encapsulated. In other words, the plasticizer is substantially covered with a resin. This resin covering the plasticizer is hereinafter referred to as a "covering resin", and the plasticizer together with the covering resin is hereinafter referred to as a "capsule".

Specific preferred examples of suitable plasticizers include, but are not limited to, compounds having a boiling point of 180° C. or more, such as esters including fatty acid esters, aromatic acid esters (e.g., phthalic acid esters), phosphates, maleates, fumarates, and itaconates; ketones including benzyl, benzoine, and benzoyl compounds; and fatty acid amide compounds. More specifically, suitable plasticizers include, but are not limited to, diethyl phthalate, diethyl succinate, diisodecyl phthalate, diisoheptyl phthalate, dimethyl fumarate, monoethyl fumarate, monobutyl fumarate, monomethyl itaconate, monobutyl itaconate, diphenyl adipate, dibenzyl terephthalate, stearyl stearamide, oleyl stearamide, and stearyl oleamide.

Suitable plasticizers preferably have a melting point of from 40 to 140° C. Plasticizer having too low a melting point may exude from the toner components liquid at a time of emulsification and the resultant image may be sticky. Plasticizer having too high a melting point may not sufficiently melt.

Suitable plasticizers preferably have a boiling point of 180° C. or more, and more preferably 200° C. or more. Plasticizer having too low a boiling point may not function.

A suitable amount of the plasticizer is preferably from 5 to 80% by weight, more preferably from 5 to 60% by weight, based on the covering resin. When the amount is too small, plasticizing effect may be insufficient. When the amount is too large, the strength of the resultant capsule may deteriorate and therefore the plasticizer may exude from the capsule upon application of thermal and/or mechanical stresses.

The covering resin comprises a vinyl resin or a polyester resin. The capsule is formed by know methods such as interfacial polymerization methods, in-situ polymerization methods, phase separation methods, and coacervation methods. Among these methods, interfacial polymerization methods and in-situ polymerization methods are preferable. In a typical interfacial polymerization method, a water-immiscible oily phase containing a hydrophobic monomer (i.e., a core material) is dispersed in an aqueous phase containing a hydrophilic monomer to form fine droplets of the oily phase, so that polymerizations occur at interfaces between the oily phase droplets and the aqueous phase. In a typical in-situ polymerization method, a monomer and a polymerization initiator are supplied from either one of an internal phase or an external phase so that a polymer is formed covering the surface of a core material uniformly.

Suitable covering resins preferably have a glass transition temperature of from 50 to 100° C. When the glass transition temperature is too low, heat-resistant storage stability may be poor. When the glass transition temperature is too high, the plasticizer may not exude from the toner when being fixed on a recording sheet.

The capsule preferably has a weight average particle diameter of from 0.1 to 2 μm, measured by LA-920 from Horiba, Ltd. When the weight average particle diameter is too small, the toner may need to include extremely large an amount of the capsule to express sufficient plasticity, while degrading mechanical strength of the toner. When the weight average particle diameter is too large, the capsule may be unevenly dispersed in the toner because the toner has a small diameter of 10 μm or less.

When being produced by an ester elongation polymerization method, the diameter of the resultant capsule may be controlled appropriately by changing the amount of a dispersion stabilizer (such as an organic particulate resin) in an aqueous medium or that of isophoronediamine in the emulsification process.

Suitable vinyl resins may be formed from a polymerization between an ethylene-based unsaturated monomer and a (meth)acrylate, or two acrylates, using a polymerization initiator.

The covering resin and the binder resin preferably have high compatibility with each other. It is more preferable that the covering resin more easily melts than the binder resin, because a greater amount of the covering resin is in contact with the plasticizer than the binder resin. To make the covering resin easily melt, the cross-linking density thereof may be reduced as appropriate.

The toner of the present invention includes a binder resin and at least one of black, yellow, magenta, and cyan colorants. The toner of the present invention may optionally include a charge controlling agent, a release agent such as a wax, a fluidity improving agent, an antioxidant, and the like. Release agents and fluidity improving agents may be either internally or externally added to the toner. The toner of the present invention may be manufactured by physical methods such as pulverization methods. A typical pulverization method includes mixing toner components, melt-kneading the mixture, and pulverizing the melt-kneaded mixture into particles, optionally followed by classifying the particles by size.

Alternatively, the toner of the present invention may be manufactured by chemical methods, such as dry granulation methods in which a binder resin is dissolved in a solvent, the solution is formed into droplets, and the solvent is removed from the droplets; solidification granulation methods in which an aqueous medium is removed from an O/W emulsion; emulsion aggregation methods; suspension polymerization methods; and partial polymerization methods in which a precursor of a binder resin (e.g., a polyester resin) is elongated in a liquid. Of course, the toner of the present invention can be manufactured by a combination of physical methods and chemical methods.

Specific preferred examples of suitable binder resins include, but are not limited to, polyester resins, acrylate resins, methacrylate resins, styrene-acrylate copolymer resins, styrene-methacrylate copolymer resins, epoxy resins, and COC (cyclic olefin resins such as TOPAS-COC from Ticona). From the viewpoint of improving resistance to stress applied in developing devices, styrene-acrylate copolymer resins, styrene-methacrylate copolymer resins, and polyester resins are preferable. These resins may be used alone or in combination.

Specific preferred examples of suitable colorants for use in the toner include any known dyes and pigments such as carbon black, Nigrosine dyes, black iron oxide, NAPHTHOL YELLOWS, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone, etc. These materials can be used alone or in combination. The toner preferably includes a colorant in an amount of from 1 to 15% by weight, and more preferably from 3 to 10% by weight.

The toner preferably includes a wax as release agent. Specific preferred examples of suitable waxes include, but are not limited to, polyolefin waxes (e.g., polyethylene wax, polypropylene wax), long-chain hydrocarbons (e.g., paraffin wax, SASOL wax), and waxes having a carbonyl group. Specific examples of the waxes having a carbonyl group include, but are not limited to, esters of polyalkanoic acids (e.g., carnauba wax, montan wax, trimethylolpropane tribehenate, pentaerythritol tetrabehenate, pentaerythritol diacetate dibehenate, glycerin tribehenate, 1,18-octadecanediol distearate), polyalkanol esters (e.g., tristearyl trimellitate, distearyl maleate), polyalkanoic acid amides (e.g., ethylenediamine dibehenyl amide), polyalkylamides (e.g., trimellitic acid tristearylamide), and dialkyl ketones (e.g., distearyl ketone) Among these waxes having a carbonyl group, polyalkanoic acid esters are preferable.

Specifically, waxes having a low polarity are preferable, such as polyethylene waxes, polypropylene waxes, paraffin waxes, SASOL waxes, microcrystalline waxes, and Fisher-Tropsch waxes. The toner includes the wax in an amount of 3 to 15% by weight, preferably 4 to 12% by weight, and more preferably 5 to 10% by weight, based on 100% by weight of the binder resin. When the amount of wax is too small, the wax may not sufficiently function as release agent and cause hot offset. When the amount of wax is too large, the wax may exude from toner particles upon application of thermal and mechanical stresses and may contaminate image forming members such as photoreceptor, resulting in low-grade images. In addition, the wax may spread outside of image portions when an image is formed on an OHP sheet, resulting in low-grade projected images.

The toner may optionally include a charge controlling agent. Specific examples of the charge controlling agents include known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, and salicylic acid derivatives, but are not limited thereto.

Specific examples of commercially available charge controlling agents include, but are not limited to, BONTRON® N-03 (Nigrosine dyes), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® PR (triphenyl methane derivative), COPY CHARGE® NEGVP2036 and COPY CHARGE® NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, and azo pigments and polymers having a functional group such as a sulfonate group, a carboxyl group, and a quaternary ammonium group.

The content of the charge controlling agent is determined depending on the species of the binder resin used, and toner manufacturing method (such as dispersion method) used, and is not particularly limited. However, the content of the charge controlling agent is typically from 0.08 to 6 parts by weight, and preferably from 0.2 to 3.5 parts by weight, per 100 parts by weight of the binder resin included in the toner.

The toner may include inorganic particles and/or polymer particles so as to improve fluidity, developability, and chargeability.

The inorganic particles preferably have a primary particle diameter of 5 nm to 2 μm, and more preferably 5 nm to 500 nm, and a BET specific area of 20 to 500 $m^2/g$. The toner preferably includes the inorganic particles in an amount of 0.01 to 5% by weight, and more preferably 0.01 to 2.0% by weight. Specific examples of the inorganic particles include, but are not limited to, particles of silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride.

Specific examples of usable polymer particles include, but are not limited to, particles of a polystyrene which are manufactured by a method such as soap-free emulsion polymerization method, suspension polymerization method, or dispersion polymerization method; methacrylate or acrylate copolymers; polycondensation resins such as silicone, benzoguanamine, and nylon resins; and thermosetting resins.

The above-described fluidity improving agents may be surface-treated so that hydrophobicity is increased. The higher the hydrophobicity, the better the fluidity and chargeability even in highly humid conditions. Specific examples of usable surface treatment agents include, but are not limited to, silane-coupling agents, silylation agents, silane-coupling agents having a fluorinated alkyl group, organic titanate coupling agents, aluminum coupling agents, silicone oils, and modified silicone oils.

Description is now given of methods for manufacturing toners.

First, pulverization methods are described in detail below. In a typical pulverization method, first, a binder resin and toner components are mixed at a desired ratio and the mixture is melt-kneaded. The melt-kneaded mixture is then pulverized into particles, and the pulverized particles are classified so that desired sized particles are collected. Thus, mother toner particles are prepared. The shape of mother toner particles can be optionally controlled. For example, the circularity can be improved by applying mechanical impact using an instrument such as HYBRIDIZER (from Nara Machinery Co., Ltd.) and MECHANOFUSION® (from Hosokawa Micron Corporation).

Preferably, toner components are mixed using a typical powder mixer. More preferably, the powder mixer is equipped with a jacket so that the inner temperature can be controlled. The rotation number, rolling speed, mixing time, and temperature of the powder mixer may be variable. In the mixing, a relatively high stress may be applied first and subsequently a relatively low stress may be applied, or vice versa. Specific examples of usable mixers include, but are not limited to, V-form mixers, locking mixers, Loedge Mixers, NAUTER MIXERS, and HENSCHEL MIXERS.

The mixture is melt-kneaded using a single-axis or double-axis continuous kneader or a batch kneader using roll mill. Specific examples of commercially available usable kneaders include, but are not limited to, TWIN SCREW EXTRUDER KTK from Kobe Steel, Ltd., TWIN SCREW COMPOUNDER TEM from Toshiba Machine Co., Ltd., MIRACLE K.C.K from Asada Iron Works Co., Ltd., TWIN SCREW EXTRUDER PCM from Ikegai Co., Ltd., KOKNEADER from Buss Corporation, etc. The melt-kneading process should be performed such that molecular chains of binder resin are not cut.

The melt-kneaded mixture is pulverized into particles. Preferably, the melt-kneaded mixture is pulverized into coarse particles first and subsequently the coarse particles are pulverized into fine particles. Suitable pulverization methods include, but are not limited to, a method in which particles collide with a collision board in a jet stream; a method in which particles collide with each other in a jet stream; and a method in which particles are pulverized in a narrow gap formed between a mechanically rotating rotor and a stator.

The fine particles thus pulverized are classified so that desired-sized particles are obtained. Suitable classification methods include, but are not limited to, cyclone separation, decantation, and centrifugal separation. Ultra-fine particles can be removed by these methods.

After being subjected to the classification mentioned above, the particles are further classified by a centrifugal force in airflow to collect predetermined-sized particles, i.e., mother toner particles.

To enhance fluidity, storage stability, developability, and transferability, fine particles of an inorganic material such as hydrophobized silica (hereinafter "external additive") may be mixed with the mother toner particles. The mixing can be performed using a typical powder mixer. Preferably, the powder mixer is equipped with a jacket so that the inner temperature can be controlled. By changing the timing when the external additive is added or the addition speed of the external additive, the stress on the external additive, in other words, the adhesion state of the external additive with the mother toner particles can be changed. The rotation number, rolling speed, mixing time, and temperature of the powder mixer may be variable. In the mixing, a relatively high stress may be applied first and subsequently a relatively low stress may be applied, or vice versa. Specific examples of usable mixers include, but are not limited to, V-form mixers, locking mixers, Loedge Mixers, NAUTER MIXERS, and HENSCHEL MIXERS. The mixed particles thus prepared may be passed through a sieve having an opening of 250 mesh or more to remove coarse particles and aggregated particles.

As well as the pulverization method described above, the following chemical methods are preferable: dry granulation methods in which droplets of a solvent in which a binder resin is dissolved are dried; solidification granulation methods in which an aqueous medium is removed from an O/W emulsion; emulsion aggregation methods; suspension polymerization methods; and partial polymerization methods in which a binder resin precursor is elongated in liquid (hereinafter "elongation-in-liquid method"). Among these methods, emulsion aggregation methods, suspension polymerization methods, and elongation-in-liquid methods are described in detail below.

An exemplary description is now given of emulsion aggregation methods. A toner prepared by an emulsion aggregation method includes a binder resin, a wax, and a colorant. The binder resin includes a vinyl resin formed from a radical-polymerizable monomer and may include other resins such as a polyester resin. In the emulsion aggregation method, a colorant dispersion, a binder resin latex, and a wax dispersion are subjected to aggregation in an aqueous medium so that aggregated particles containing the colorant, binder resin, and wax are formed. The aggregated particles thus prepared are then washed and dried, resulting in preparation of mother toner particles. More specifically, a radical-polymerizable monomer, a wax, a colorant, and an optional polyester resin are emulsified and aggregated in an aqueous medium, and the resultant aggregated particles are heated so that they are fused with each other.

The vinyl resin formed from a radical-polymerizable monomer is not limited to any particular resins. Multiple vinyl resins may be used in combination. The vinyl resin preferably has a weight average molecular weight of 50,000 or less, and more preferably 30,000 or less. When the weight average molecular weight is too large, low-temperature fixability of the resultant toner may deteriorate. The vinyl resin preferably has a glass transition temperature of 40 to 80° C., and more preferably 50 to 70° C. When the glass transition temperature is too high, low-temperature fixability of the resultant toner may deteriorate. When the glass transition temperature is too low, heat-resistant storage stability of the resultant toner may deteriorate.

The vinyl resin is formed by a copolymerization of vinyl monomers. Specific examples of usable vinyl monomers include, but are not limited to, (1) vinyl hydrocarbons (e.g., aliphatic vinyl hydrocarbons, alicyclic vinyl hydrocarbons, aromatic vinyl hydrocarbons), (2) vinyl monomers having a carboxyl group (e.g., acrylic acid, methacrylic acid, maleic acid, maleic anhydride, monoalkyl maleate, fumaric acid, monoalkyl fumarate, crotonic acid, itaconic acid, monoalkyl itaconate, itaconic acid glycol monoether, citraconic acid, monoalkyl citraconate, cinnamic acid) and salts thereof, (3) vinyl monomers having a sulfonic acid group and vinyl monoesters of sulfuric acids and salts thereof, (4) vinyl monomers having a phosphoric acid group and salts thereof, (5) vinyl monomers having a hydroxyl group, (6) nitrogen-containing vinyl monomers, (7) vinyl monomers having an epoxy group, (8) vinyl esters, vinyl ethers, vinyl thioethers, vinyl ketones, and vinyl sulfones, (9) vinyl monomers such as isocyanatoethyl acrylate, isocyanatoethyl methacrylate, m-isopropenyl-α,α-dimethylbenzyl isocyanate, and monomers having an alkyloxysilyl group, and (10) fluorine-containing vinyl monomers.

The optional polyester resin, which is used if needed, is not limited to any particular resins. Multiple polyester resins may be used in combination. Specifically, crystalline polyester resins are preferable because of providing both storage stability and low-temperature fixability.

An exemplary description is now given of suspension polymerization methods. In a typical suspension polymerization method, oil droplets of a polymerizable monomer composition in which a colorant and a wax are dispersed in a polymerizable monomer are subjected to suspension polymerization in an aqueous medium so that particles are produced. The particles thus produced are washed and dried, resulting in preparation of mother toner particles.

A polar resin such as polyester may be used for the suspension polymerization method. When a polar resin is added in the process of dispersing or polymerization of monomers, the polar resin may form a thin layer thereof on the surfaces of resultant toner particles or have a concentration gradient from the surface to the interior of each of the resultant toner particles, depending on the polar balance between the polymerizable monomer composition and the aqueous medium. If the polar resin has a certain interaction with a colorant or magnetic material (optionally usable for preparing a magnetic toner), the colorant or magnetic material can be dispersed in resultant toner particles appropriately.

The polar resin is preferably added in an amount of from 1 to 25 parts by weight, and more preferably from 2 to 15 parts by weight, based on 100 parts by weight of the binder resin. When the amount is too small, the polar resin may be unevenly dispersed in toner particles. When the amount is too large, the polar resin may form too thick a layer on the surfaces of toner particles.

Specific examples of suitable polar resins include, but are not limited to, polyester resins, epoxy resins, styrene-acrylic resins, styrene-methacrylic acid copolymers, and styrene-maleic acid copolymers. Specifically, polyester resins having a molecular weight distribution having a peak at 3,000 to 10,000 are preferable because such resins provide fluidity, negative chargeability, and transparency.

A cross-linking agent may be added when the binder resin is formed so as to increase mechanical strength and molecular weight of the resultant toner.

Specific examples of usable cross-linking agents include, but are not limited to, difunctional cross-linking agents such as divinylbenzene, bis(4-acryloxypolyethoxyphenyl)propane, ethylene glycol diacrylate and dimethacrylate, 1,3-butylenediol diacrylate and dimethacrylate, 1,4-butanediol diacrylate, 1,5-pentanediol diacrylate, 1,6-hexanediol diacrylate and dimethacrylate, neopentyl glycol diacrylate and dimethacrylate, diethylene glycol diacrylate and dimethacrylate, triethylene glycol diacrylate and dimethacrylate, tetraethylene glycol diacrylate and dimethacrylate, diacrylates and dimethacrylates of polyethylene glycols #200, #400, and #600, dipropylene glycol diacrylate and dimethacrylate, polypropylene glycol diacrylate and dimethacrylate, and polyester-based diacrylate (MANDA from Nippon Kayaku Co., Ltd.) and dimethacrylate; and polyfunctional cross-linking agents such as pentaerythritol triacrylate, trimethylolethane triacrylate, trimethylolpropane triacrylate, tetramethylolmethane tetraacrylate, oligoester acrylate and methacrylate, 2,2-bis(4-methacryloxy-polyethoxyphenyl) propane, diallyl phthalate, triallyl cyanurate, triallyl isocyanurate, and triallyl trimellitate.

The cross-linking agent is preferably added in an amount of from 0.05 to 10 parts by weight, and more preferably from 0.1 to 5 parts by weight, based on 100 parts by weight of the polymerizable monomer.

Suitable polymerization initiators for use in the suspension polymerization methods include, but are not limited to, azo and diazo polymerization initiators such as 2,2'-azobis-(2,4-dimethyl valeronitrile), 2,2'-azobis isobutyronitrile, 1,1'-azobis(cyclohexane-1-carbonitrile), 2,2'-azobis-4-methoxy-2,4-dimethyl valeronitrile, and azobis isobutyronitrile; and peroxide polymerization initiators such as benzoyl peroxide, methyl ethyl ketone peroxide, diisopropyl peroxycarbonate, cumene hydroperoxide, 2,4-dichlorobenzoyl peroxide, and lauroyl peroxide. The polymerization initiator is typically used in an amount of from 5 to 20 parts by weight based on 100 parts by weight of the polymerizable monomer, but it depends on the desired degree of polymerization. A suitable polymerization initiator may be selected depending on 10-hour half-life temperature. Of course, multiple polymerization initiators can be used in combination.

The aqueous medium for use in the suspension polymerization method is prepared using a dispersing agent. Specific examples of usable dispersing agents include, but are not limited to, inorganic dispersing agents such as tricalcium phosphate, magnesium phosphate, aluminum phosphate, zinc phosphate, magnesium carbonate, calcium carbonate, calcium hydroxide, magnesium hydroxide, aluminum hydroxide, calcium metasilicate, calcium sulfate, barium sulfate, bentonite, silica, and alumina; and organic dispersing agents such as polyvinyl alcohol, gelatine, methylcellulose, methylhydroxylpropyl cellulose, ethylcellulose, sodium salt of carboxymethyl cellulose, and starch.

In addition, commercially available nonionic, anionic, and cationic surfactants can be used, such as sodium dodecyl sulfate, sodium tetradecyl sulfate, sodium pentadecyl sulfate, sodium octyl sulfate, sodium oleate, sodium laurate, potassium stearate, and calcium oleate.

Among these dispersing agents, inorganic dispersing agents with poor water solubility are preferable for preparing the aqueous medium for use in the suspension polymerization method. Further, such inorganic dispersing agents with poor water solubility are preferably soluble in acids. Such an inorganic dispersing agent is preferably used in an amount of from 0.2 to 2.0 parts by weight based on 100 parts by weight of the polymerizable monomer. The aqueous medium preferably includes water in an amount of from 300 to 3,000 parts by weight based on 100 parts by weight of the polymerizable monomer composition.

To prepare an aqueous medium in which an inorganic dispersing agent with poor water solubility is dispersed, a commercially available inorganic agent may be directly dispersed in water. Alternatively, an inorganic dispersing agent with poor water solubility may be produced in a process in which water is agitated at a high speed. For example, mixing a sodium phosphate aqueous solution and a calcium chloride aqueous solution at a high speed may form fine particles of tricalcium phosphate.

In a typical suspension polymerization method, oil droplets of a polymerizable monomer composition in which a colorant and a wax are dispersed in a polymerizable monomer are subjected to suspension polymerization in an aqueous medium so that particles are produced.

Preferably, each toner component is evenly dispersed in a toner particle. Therefore, toner components are preferably evenly dispersed in the polymerizable monomer composition.

To evenly disperse toner components in the polymerizable monomer composition, a sufficient shearing force may be applied thereto. Accordingly, the polymerizable monomer composition preferably has a certain viscosity. To increase viscosity of the polymerizable monomer composition, other resins may be dissolved therein or part of the polymerizable monomer may be previously subjected to polymerization.

Because a part of shearing energy applied to the polymerizable monomer composition is transformed into thermal energy, cooling is required as appropriate. When cooling is insufficient for the generated heat, the temperature of the polymerizable monomer composition may increase, resulting in decrease of viscosity. As a consequence, the polymerizable monomer composition cannot be given a sufficient shearing force and toner components cannot be evenly dispersed therein.

In contrast, when the shearing force is too large, toner components may be excessively dispersed in the polymerizable monomer composition, resulting in an unstable dispersion. As a consequence, the toner components may be aggregated and cause lowering of image density.

Specific examples of suitable dispersers for dispersing the polymerizable monomer composition include, but are not limited to, ultrasonic dispersers, pressure dispersers such as mechanical homogenizer, MANTON GAULIN HOMOGENIZER, CLEAR MIX, CLEAR SS5, and pressure homogenizer, and media dispersers such as attritor, sand grinder, GETZMANN MILL, and diamond fine mill.

The colorant may be surface-treated. One possible method for the surface treatment includes dispersing a colorant in a solvent, adding a surface treatment agent in the dispersion, and heating the dispersion so as to react the colorant and the surface treatment agent, filtering the reacted dispersion, repeatedly washing the deposited surface-treated colorant with the solvent, and drying the surface-treated colorant.

An exemplary description is now given of elongation-in-liquid methods. A typical elongation-in-liquid method includes dispersing an oily liquid containing a colorant, a modified polyester (X) having an isocyanate group, and an unmodified polyester (Y) in an aqueous medium containing a surfactant so that toner particles including a modified polyester (Z) having urea group and the unmodified polyester (Y) are produced. Preferably, the unmodified polyester (Y) has no isocyanate group and a specific acid value (15 mgKOH/g or more, for example). As an elongation and/or cross-linking agent for the modified polyester (X) having an isocyanate group, low-molecular-weight polyamines and polyols are preferable. Generally speaking, polymerization toners have advantages in fixability and image quality. Among various polymerization toners, toners prepared by elongation-in-liquid methods have excellent fixability because of including polyester resins and cross-linking structure. In order to more improve fixability, the cross-linking structure may be formed flexible, the unmodified polyester may have an appropriate polarity, and/or the amount of elongation and/or cross-linking agents (such as low-molecular-weight polyamines and polyols) may be reduced so that a part of terminal isocyanates of prepolymers react with water to become amines and the amines and residual isocyanates are reacted, which results in reduction of the amount of urea bonds in half.

The unmodified polyester (Y) has a certain polarity. Further, the unmodified polyester (Y) has a relatively low molecular weight and few cross-linking structures. The unmodified polyester (Y) preferably has a high acid value so as to have affinity for paper. Such a polyester may permeate and anchor into paper when a resultant toner image is fixed on the paper.

One example of the elongation-in-liquid methods will be described. First, an isocyanate-modified polyester (X) that has isocyanate groups on ends of molecular chains, an unmodified polyester (Y) that has no isocyanate group, a polyamine compound, and toner components such as a colorant, a release agent, a charge controlling agent, and a viscosity controlling agent are dissolved or dispersed in an organic solvent to prepare an oily liquid. Next, an aqueous medium containing a low-molecular-weight surfactant and/or a high-molecular-weight dispersant (e.g., particulate resin) is prepared. The oily liquid and the aqueous medium thus prepared are mixed and agitated so that the oily liquid is dispersed, in other words, emulsified in the aqueous medium. At the time of the emulsification, the oily liquid is formed into liquid droplets while the isocyanate groups of the isocyanate-modified polyester (X) and the amine groups of the polyamine compound are reacted. Thus, the isocyanate-modified polyester (X) is elongated forming urea bonds, resulting in formation of toner particles. Since the unmodified polyester (Y) has a function of permeating into paper, the molecular weight thereof is preferably low.

It is considered that the polyamine compound has functions of not only elongating the isocyanate-modified polyester (X) but also assisting dispersing of the isocyanate-modified polyester (X) in the aqueous medium. This is thought to be the case, because when the emulsification is performed without the polyamine compound, particles are formed that are too large or no particle is formed, which indicates that the emulsification is unstable. In particular, when the unmodified polyester (Y) has too high an acid value, the emulsification is more unstably performed and particles cannot be formed even if the amount of the low-molecular-weight surfactant and/or high-molecular-weight dispersant is increased.

Taking the concept even further, a part of the polyamine compound is considered to escape from the oily liquid into the aqueous medium and controls pH of the aqueous medium. Therefore, in a case in which an inorganic base such as sodium hydroxide or potassium hydroxide control the pH instead of the polyamine compound, the stable dispersion can be performed even without the polyamine compound.

Heat-resistant storage stability of a toner formed by the above-described method depends on the glass transition temperature of the unmodified polyester resin (Y). Accordingly, the unmodified polyester resin (Y) preferably has a glass transition temperature of 35 to 65° C. When the glass transition temperature is too low, heat-resistant storage stability may be poor. When the glass transition temperature is too high, low-temperature fixability may be poor.

The unmodified polyester (Y) is not limited to any particular polyester, but polycondensation products of a polyol (1) and a polycarboxylic acid (2) are preferable.

Specific examples of usable polyols (1) include, but are not limited to, alkylene glycols such as ethylene glycol, 1,2-propylene glycol, 1,3-propylene glycol, 1,4-butanediol, and 1,6-hexanediol; alkylene ether glycols such as diethylene glycol, triethylene glycol, dipropylene glycol, polyethylene glycol, polypropylene glycol, and polytetramethylene ether glycol; alicyclic diols such as 1,4-cyclohexane dimethanol and hydrogenated bisphenol A; bisphenols such as bisphenol A, bisphenol F, and bisphenol S; 4,4'-dihydroxy biphenyls such as 3,3'-difluoro-4,4'-dihydroxy biphenyl; bis(hydroxyphenyl)alkanes such as bis(3-fluoro-4-hydroxyphenyl) methane, 1-phenyl-1,1-bis(3-fluoro-4-hydroxyphenyl) ethane, 2,2-bis(3-fluoro-4-hydroxyphenyl)propane, 2,2-bis (3,5-difluoro-4-hydroxyphenyl)propane (sometimes called tetrafluorobisphenol A), and 2,2-bis(3-hydroxyphenyl)-1,1,1,3,3,3-hexafluoropropane; bis(4-hydroxyphenyl) ethers such as bis(3-fluoro-4-hydroxyphenyl) ether; alkylene oxide (e.g., ethylene oxide, propylene oxide, butylene oxide) adducts of the above-described alicyclic diols; and alkylene oxide (e.g., ethylene oxide, propylene oxide, butylene oxide) adducts of the above-described bisphenols.

Among these compounds, alkylene glycols having 2 to 12 carbon atoms and alkylene oxide adducts of bisphenols are preferable, and combination of alkylene glycols having 2 to 12 carbon atoms and alkylene oxide adducts of bisphenols are more preferable.

In addition, polyvalent aliphatic alcohols having 3 or more valences such as glycerin, trimethylolethane, trimethylolpropane, pentaerythritol, and sorbitol; phenols having 3 or more valences such as trisphenol PA, phenol novolac, and cresol novolac; and alkylene oxide adducts of polyphenols having 3 or more valences are also usable as the polyol (1).

These polyols can be used alone or in combination.

Specific examples of usable polycarboxylic acids (2) include, but are not limited to, alkylene dicarboxylic acids such as succinic acid, adipic acid, and sebacic acid; alkenylene dicarboxylic acids such as maleic acids and fumaric acid; and aromatic dicarboxylic acids such as phthalic acid, isophthalic acid, terephthalic acid, naphthalene dicarboxylic acid, 3-fluoroisophthalic acid, 2-fluoroisophthalic acid, 2-fluoroterephthalic acid, 2,4,5,6-tetrafluoroisophthalic acid, 2,3,5,6-tetrafluoroterephthalic acid, 5-trifluoromethyl isophthalic acid, 2,2-bis(4-carboxyphenyl)hexafluoropropane, 2,2-bis(4-carboxyphenyl)hexafluoropropane, 2,2-bis(3-carboxyphenyl)hexafluoropropane, 2,2'-bis(trifluoromethyl)-4,4'-biphenyl dicarboxylic acid, 3,3'-bis(trifluoromethyl)-4,4'-biphenyl dicarboxylic acid, 2,2'-bis(trifluoromethyl)-3,3'-biphenyl dicarboxylic acid, and hexafluoroisopropylidene diphthalic acid anhydride.

Among these compounds, alkenylene dicarboxylic acids having 4 to 20 carbon atoms and aromatic dicarboxylic acids having 8 to 20 carbon atoms are preferable.

In addition, polycarboxylic acid having 3 or more valences including aromatic polycarboxylic acids having 9 to 20 carbon atoms such as trimellitic acid and pyromellitic acid, and anhydrides and lower alkyl esters (e.g., methyl ester, ethyl ester, isopropyl ester) of the above-described compounds are also usable as the polycarboxylic acid (2).

These polycarboxylic acids can be used alone or in combination.

The equivalent ratio [OH]/[COOH] of hydroxyl groups [OH] in the polyol (1) and carboxyl groups [COOH] in the polycarboxylic acid (2) is typically 2/1 to 1/1, preferably 1.5/1 to 1/1, and more preferably 1.3/1 to 1.02/1.

The unmodified polyester (Y) typically has a molecular weight distribution having a peak within a molecular weight range of 1,000 to 30,000, preferably 1,500 to 10,000, and more preferably 2,000 to 8,000. When the peak is at too small a molecular weight, heat-resistant storage stability may be poor. When the peak is at too large a molecular weight, low-temperature fixability may be poor.

The isocyanate-modified polyester (X) may be a reaction product of a polyisocyanate and a polyester (A) which is a polycondensation product of a polyol (Ao) and a polycarboxylic acid (Ac) and which has an active hydrogen group. The polyol (Ao) and the polycarboxylic acid (Ac) are equivalent to the polyol (1) and the polycarboxylic acid (2) described above, respectively. Specific examples of the active hydrogen groups include, but are not limited to, alcoholic hydroxyl groups, phenolic hydroxyl groups, amino groups, carboxylic groups, and mercapto groups. Among these groups, alcoholic hydroxyl groups are preferable.

Specific examples of usable polyisocyanates include, but are not limited to, aliphatic polyisocyanates such as tetramethylene diisocyanate, hexamethylene diisocyanate, and 2,6-diisocyanatomethyl caproate; alicyclic polyisocyanates such as isophorone diisocyanate and cyclohexylmethane diisocyanate; aromatic diisocyanates such as tolylene diisocyanate and diphenylmethane diisocyanate; aromatic aliphatic diisocyanates such as $\alpha,\alpha,\alpha',\alpha'$-tetramethylxylylene diisocyanate; isocyanurates; the above-described polyisocyanates blocked with a phenol derivative, oxime, or caprolactam; and mixtures thereof.

The equivalent ratio [NCO]/[OH] of isocyanate groups [NCO] in the polyisocyanate hydroxyl groups [OH] in the polyester (A) is typically 5/1 to 1/1, preferably 4/1 to 1.2/1, and more preferably 2.5/1 to 1.5/1. When [NCO]/[OH] is too large, low-temperature fixability may be poor. When [NCO]/[OH] is too small, cross-linking density of the elongated and/or cross-linked isocyanate-modified polyester (X) may be low, possibly degrading offset resistance.

The isocyanate-modified polyester (X) typically includes the polyisocyanate units in an amount of 0.5 to 40% by weight, preferably 1 to 30% by weight, and more preferably 2 to 20% by weight. When the amount is too small, hot offset resistance may be poor. When the amount is too large, low-temperature fixability may be poor.

The number of isocyanate groups included in the isocyanate-modified polyester (X) is typically 1 or more, preferably 1.5 to 3, and more preferably 1.8 to 2.5 per molecule. When the number is too small, the molecular weight of the elongated and/or cross-linked isocyanate-modified polyester (X) may be low, possibly degrading offset resistance.

The colorant can be combined with a resin to be used as a master batch. Specific examples of usable resin for the master batch include, but are not limited to, the above-described modified and unmodified polyester resins, styrene polymers and substituted styrene polymers (e.g., polystyrene, poly-p-chlorostyrene, polyvinyltoluene), styrene copolymers (e.g., styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloro methacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, styrene-maleic acid ester copolymer), polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic acid, rosin, modified rosin, terpene resin, aliphatic or alicyclic hydrocarbon resin, aromatic petroleum resin, chlorinated paraffin, and paraffin wax. These resins can be used alone or in combination.

The master batches can be prepared by mixing one or more of the resins as described above and the colorant as described above and kneading the mixture while applying a high shearing force thereto. In this case, an organic solvent can be added to increase the interaction between the colorant and the resin. In addition, a flushing method in which an aqueous paste including a colorant and water is mixed with a resin dissolved in an organic solvent and kneaded so that the colorant is transferred to the resin side (i.e., the oil phase), and then the organic solvent (and water, if desired) is removed, can be preferably used because the resultant wet cake can be used as it is without being dried. When performing the mixing and kneading process, dispersing devices capable of applying a high shearing force such as three roll mills can be preferably used.

Specific examples of usable release agents include the above-described release agents usable for the pulverization methods.

The above-described usable external additives such as fine particles of inorganic materials and/or polymers may be also used to improve fluidity, developability, and chargeability of the resultant toner.

A cleanability improving agent may be added to the toner so that toner particles which remain on the surface of photoreceptor or primary transfer medium without being transferred are easily removed. Specific examples of usable cleanability improving agents include, but are not limited to, metal salts of fatty acids such as such as zinc stearate and calcium stearate; and particulate polymers such as polymethyl methacrylate and polystyrene, which are manufactured by a method such as soap-free emulsion polymerization methods. Particulate resins having a relatively narrow particle diameter distribution and a volume average particle diameter of from 0.01 μm to 1 μm are preferably used as the cleanability improving agent.

Volatile organic solvents having a boiling point of less than 100° C. are suitable for dissolving or dispersing the unmodified polyester resin, the modified polyester resin having an isocyanate group, a colorant, and a release agent because such solvents are easily removed in succeeding processes. Specific examples of such organic solvents include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These solvents can be used alone or in combination. Among these solvents, ester solvents such as methyl acetate and ethyl acetate, aromatic solvents such as toluene and xylene, and halogenated hydrocarbons such as methylene chloride, 1,2-dichloroethane, chloroform, and carbon tetrachloride are preferable. The polyester resins, colorant, and release agent may be dissolved or dispersed in the solvent simultaneously. Alternatively, each of them may be separately dissolved or dispersed in a separate solvent. In this case, the separate solvents may be, but need not necessarily be, the same. However, in consideration of solvent removal in succeeding processes, the separate solvents are preferably the same.

The resultant solution or dispersion preferably contains the polyester resins in an amount of 40 to 80% by weight. When the amount of the polyester resins is too large, the solution or dispersion may be hard to be emulsified and handled because the viscosity thereof is too high. When the amount of the polyester resins is too small, productivity of toner may reduce.

The unmodified resin and the modified polyester resin having an isocyanate group may be dissolved or dispersed in the same solvent simultaneously. Alternatively, each of them may be dissolved or dispersed in a separate solvent. However, in consideration of the difference in solubility and viscosity, each of them is preferably dissolved or dispersed in a separate solvent.

The colorant may be dissolved or dispersed in the solvent alone. Alternatively, the colorant may be mixed with the solution or dispersion in which the polyester resins are dissolved or dispersed. A dispersing auxiliary agents and another polyester resin may be added if needed. The colorant master batch described above can be also usable.

When the release agent is to be dispersed in a solvent in which the release agent is insoluble, the release agent is preferably mixed with the solvent using a dispersing machine such as bead mill. More preferably, after mixing the release agent with the solvent, the mixture is once heated to the melting point of the release agent and subsequently cooled while being agitated, followed by dispersing using the bead mill described above. This procedure may make the dispersing time shorter. Of course, multiple release agents can be used in combination, and a dispersing auxiliary agent and another polyester resins may be added, if needed.

As the aqueous medium, water alone or a mixture of water and a water-miscible solvent are preferable. Specific examples of usable water-miscible solvents include, but are not limited to, alcohols such as methanol, isopropanol, and ethylene glycol; dimethylformamide; tetrahydrofuran; cellosolves such as methyl cellosolve; and lower ketones such as acetone and methyl ethyl ketone. The usable amount of the aqueous medium is typically 50 to 2,000 parts by weight, and preferably 100 to 1,000 parts by weight, based on 100 parts by weight of toner components. When the amount of the aqueous medium is too small, toner components may be insufficiently dispersed therein, resulting in undesired-size toner particles. When the amount of the aqueous medium is too large, manufacturing cost may increase.

Inorganic bases are usable for controlling the pH of the aqueous medium. The purpose for using inorganic bases is to limit usage of low-molecular-weight amines and hydroxyl compounds as elongation agents and to produce amines as hydrolysis products. Specific examples of usable inorganic bases include, but are not limited to, hydroxides such as lithium hydroxide, sodium hydroxide, potassium hydroxide, cesium hydroxide, magnesium hydroxide, and calcium hydroxide; carbonates such as lithium carbonate, sodium carbonate, potassium carbonate, cesium carbonate, magnesium carbonate, and calcium carbonate; hydrogen carbonates such as lithium hydrogen carbonate, sodium hydrogen carbonate, potassium hydrogen carbonate, cesium hydrogen carbonate, magnesium hydrogen carbonate, and calcium hydrogen carbonate; and mixtures thereof. The aqueous medium is controlled to have a pH of 9 or more. More specifically, the pH is controlled depending on resins, colorants, and release agents which are to be dissolved or dispersed in an organic solvent.

Water-soluble amine compounds are also usable for controlling the pH. However, these compounds may slightly degrade chargeability of the resultant toner.

Preferably, an inorganic dispersing agent or an organic particulate resin is dispersed in the aqueous medium so that a resultant dispersion is stable and resultant toner particles have a narrow particle diameter distribution. Specific examples of usable inorganic dispersing agents include, but are not limited to, tricalcium phosphate, calcium carbonate, titanium oxide, colloidal silica, and hydroxyapatite. As the organic particulate resin, any thermoplastic and thermosetting resins capable of forming an aqueous dispersion thereof are usable. Specific examples of such resins include, but are not limited to, vinyl resins, polyurethane resins, epoxy resins, polyester resins, polyamide resins, polyimide resins, silicon resins, phenol resins, melamine resins, urea resins, aniline resins, ionomer resins, and polycarbonate resins. These resins can be used alone or in combination. Among these resins, vinyl resins, polyurethane resins, epoxy resins, polyester resins, and mixtures thereof are preferable because they can easily form an aqueous dispersion containing fine spherical particles thereof.

Specific preferred methods for forming an aqueous dispersion of a particulate resin include the following methods (a) to (h), for example.

(a) Subjecting a vinyl monomer to any one of suspension polymerization, emulsion polymerization, seed polymerization, and dispersion polymerization, so that an aqueous dispersion of a particulate resin is directly prepared.

(b) Dispersing a precursor (such as a monomer and an oligomer) of a polyaddition or polycondensation resin (such as a polyester resin, a polyurethane resin, and an epoxy resin) or a solvent solution thereof in an aqueous medium in the presence of a suitable dispersing agent, followed by heating or adding a curing agent, so that an aqueous dispersion of a particulate resin is prepared.

(c) Dissolving a suitable emulsifying agent in a precursor (such as a monomer and an oligomer) of a polyaddition or polycondensation resin (such as a polyester resin, a polyurethane resin, and an epoxy resin) or a solvent solution (preferably in liquid form, if not liquid, preferably liquefied by application of heat) thereof, and subsequently adding water thereto, so that an aqueous dispersion of a particulate resin is prepared by phase-inversion emulsification.

(d) Pulverizing a resin previously formed by a polymerization reaction (such as addition polymerization, ring-opening polymerization, polyaddition, addition condensation, condensation polymerization) using a mechanical rotational type pulverizer or a jet type pulverizer, classifying the pulverized particles to prepare a particulate resin, and dispersing the particulate resin in an aqueous medium in the presence of a suitable dispersing agent, so that an aqueous dispersion of the particulate resin is prepared.

(e) Spraying a resin solution, in which a resin previously formed by a polymerization reaction (such as addition polymerization, ring-opening polymerization, polyaddition, addition condensation, condensation polymerization) is dissolved in a solvent, into the air to prepare a particulate resin, and dispersing the particulate resin in an aqueous medium in the presence of a suitable dispersing agent, so that an aqueous dispersion of the particulate resin is prepared.

(f) Adding a poor solvent to a resin solution, in which a resin previously formed by a polymerization reaction (such as addition polymerization, ring-opening polymerization, polyaddition, addition condensation, condensation polymerization) is dissolved in a solvent, or cooling the resin solution which is previously dissolved in a solvent with application of heat, to precipitate a particulate resin, and dispersing the particulate resin in an aqueous medium in the presence of a suitable dispersing agent, so that an aqueous dispersion of the particulate resin is prepared.

(g) Dispersing a resin solution, in which a resin previously formed by a polymerization reaction (such as addition polymerization, ring-opening polymerization, polyaddition, addition condensation, condensation polymerization) is dissolved in a solvent, in an aqueous medium in the presence of a suitable dispersing agent, and removing the solvent by application of heat, reduction of pressure, and the like, so that an aqueous dispersion of a particulate resin is prepared.

(h) Dissolving a suitable emulsifying agent in a resin solution, in which a resin previously formed by a polymerization reaction (such as addition polymerization, ring-opening polymerization, polyaddition, addition condensation, condensation polymerization) is dissolved in a solvent, and subsequently adding water thereto, so that an aqueous dispersion of a particulate resin is prepared by phase-inversion emulsification.

When the oily liquid containing toner components is emulsified in the aqueous medium, a surfactant is usable, if needed. Specific examples of usable surfactants include, but are not limited to, anionic surfactants such as alkylbenzene sulfonates, α-olefin sulfonates, and phosphates; cationic surfactants such as amine salts (e.g., alkylamine salts, amino alcohol fatty acid derivatives, polyamine fatty acid derivatives, imidazoline) and quaternary ammonium salts (e.g., alkyl trimethyl ammonium salts, dialkyl dimethyl ammonium salts, alkyl dimethyl benzyl ammonium salts, pyridinium salts, alkyl isoquinolinium salts, benzethonium chloride); nonionic surfactants such as fatty acid amide derivatives and polyvalent alcohol derivatives; and ampholytic surfactants such as alanine, dodecyl di(aminoethyl) glycine, di(octyl aminoethyl) glycine, and alkyl-N,N-dimethyl ammonium betaine.

Surfactants having a fluoroalkyl group are effective even in small amounts. Specific preferred examples of usable anionic surfactants having a fluoroalkyl group include, but are not limited to, fluoroalkyl carboxylic acids having 2 to 10 carbon atoms and metal salts thereof, perfluorooctane sulfonyl glutamic acid disodium, 3-[ω-fluoroalkyl(C6-C11)oxy]-1-alkyl(C3-C4) sulfonic acid sodium, 3-[ω-fluoroalkanoyl(C6-C8)-N-ethylamino]-1-propane sulfonic acid sodium, fluoroalkyl(C11-C20) carboxylic acids and metal salts thereof, perfluoroalkyl(C7-C13) carboxylic acids and metal salts thereof, perfluoroalkyl (C4-C12) sulfonic acids and metal salts thereof, perfluorooctane sulfonic acid dimethanol amide, N-propyl-N-(2-hydroxyethyl) perfluorooctane sulfonamide, perfluoroalkyl(C6-C10) sulfonamide propyl trimethyl ammonium salts, perfluoroalkyl(C6-C10)-N-ethyl sulfonyl glycine salts, and monoperfluoroalkyl(C6-C16) ethyl phosphates.

Specific preferred examples of usable cationic surfactants having a fluoroalkyl group include, but are not limited to, aliphatic primary, secondary, and tertiary amine acids having a fluoroalkyl group, aliphatic tertiary ammonium salts such as perfluoroalkyl(C6-C10) sulfonamide propyl trimethyl ammonium salts, benzalkonium salts, benzethonium chloride, pyridinium salts, and imidazolinium salts.

Polymeric protective colloids are also usable for preparing a stable dispersion. Specific examples of usable polymeric protection colloids include, but are not limited to, homopolymers and copolymers of monomers such as acid monomers (e.g., acrylic acid, methacrylic acid, α-cyanoacrylic acid, α-cyanomethacrylic acid, itaconic acid, crotonic acid, fumaric acid, maleic acid, maleic anhydride), (meth)acrylic monomers having hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerin monoacrylate, glycerin monomethacrylate, N-methylol acrylamide, N-methylol methacrylamide), vinyl alcohols and ethers of vinyl alcohols (e.g., vinyl methyl ether, vinyl ethyl ether, vinyl propyl ether), esters of vinyl alcohols with compounds having carboxyl group (e.g., vinyl acetate, vinyl propionate, vinyl butyrate), monomers having amide bond and methylol compounds thereof (e.g., acrylamide, methacrylamide, diacetone acrylamide), acid chloride monomers (e.g., acrylic acid chloride, methacrylic acid chloride), monomers containing nitrogen or a heterocyclic ring containing nitrogen (e.g., vinyl pyridine, vinyl pyrrolidone, vinyl imidazole, ethylene imine); polyoxyethylenes such as polyoxyethylene, polyoxypropylene, polyoxyethylene alkyl amines, polyoxypropylene alkyl amines, polyoxyethylene alkyl amides, polyoxypropylene alkyl amides, polyoxyethylene nonylphenyl ethers, polyoxyethylene laurylphenyl ethers, polyoxyethylene stearylphenyl esters, and polyoxyethylene nonylphenyl esters; and celluloses such as methyl cellulose, hydroxyethyl cellulose, and hydroxypropyl cellulose.

Acid-soluble or alkaline-soluble dispersing agents such as calcium phosphate can be removed from the resultant particles by dissolving them by an acid, followed by washing with water. Alternatively, dispersing agents may be removed using enzymes. Of course, the dispersing agents may remain on the resultant particles, however, it is preferable to remove them from the viewpoint of chargeability.

To disperse (emulsify) the oily liquid in the aqueous medium, any known dispersing machines such as low-speed shearing machines, high-speed shearing machines, friction type dispersing machines, high pressure jet type dispersing machines, and ultrasonic dispersing machine can be used. In order to prepare a dispersion containing particles having particle diameters of 2 to 20 μm, high-speed shearing machines are preferable. When high-speed shearing machines are used, the rotation speed of rotors is generally from 1,000 to 30,000 rpm and preferably from 5,000 to 20,000 rpm, but is not limited thereto. The temperature at the dispersing is generally 0 to 150° C. (under pressure), and preferably from 20 to 80° C.

In order to remove the organic solvent from the thus prepared emulsion, any known removing methods can be used. For example, a method in which the emulsion is gradually heated under normal pressure or reduced pressure to completely evaporate the organic solvent in the drops of the oil phase can be used.

The isocyanate-modified polyester generally starts elongating and/or cross-linking at the time the oily liquid containing the isocyanate-modified polyester, unmodified polyester, colorant, and release agent is added to the aqueous medium. Alternatively, a reaction process for elongating and/or cross-linking the isocyanate-modified polyester may be separately performed. Conditions for the reaction process are determined depending on the activity and concentration of the isocyanate group. The reaction time is typically 1 minute to 40 hours and preferably 1 to 24 hours. The reaction temperature is typically 0 to 150° C. and preferably 20 to 98° C.

Resultant toner particles dispersed in the aqueous medium are washed and dried by a known method. For example, the toner particles and the aqueous medium are separated using a centrifugal separator or a filter press (i.e., solid-liquid separation) so that a toner cake is prepared, and then the toner cake is re-dispersed in ion-exchanged water at a temperature of room temperature to about 40° C., following by pH control using acids and bases, if desired. The solid-liquid separation is repeated several times to remove impurities and surfactants. After the washing treatment, the toner particles are subjected to a drying treatment using a flash dryer, a circulating dryer, a vacuum dryer, a vibrating fluid dryer, etc. Ultrafine particles can be removed by centrifugal separation in the liquid, or the toner particles can be subjected to a classification treatment using a known classifier after the drying treatment.

The thus prepared toner particles are then mixed with one or more other particulate materials such as charge controlling agents, fluidizers optionally upon application of mechanical impact thereto to fix the particulate materials on the toner particles. Specific examples of such mechanical impact application methods include methods in which a mixture is mixed with a highly rotated blade and methods in which a mixture is put into an air jet to collide the particles against each other or a collision plate. Specific examples of such mechanical impact applicators include, but are not limited to, ONG MILL (manufactured by Hosokawa Micron Co., Ltd.), modified I TYPE MILL in which the pressure of air used for pulverizing is reduced (manufactured by Nippon Pneumatic Mfg. Co., Ltd.), HYBRIDIZATION SYSTEM (manufactured by Nara Machine Co., Ltd.), KRYPTON SYSTEM (manufactured by Kawasaki Heavy Industries, Ltd.), and automatic mortars.

The particle diameters of toner can be measured using an instrument such as COULTER COUNTER TA-II and COULTER MULTISIZER II (from Beckman Coulter K. K.), for example.

A typical measuring method is as follows:

(1) 0.1 to 5 ml of a surfactant (preferably an alkylbenzene sulfonate) is included as a dispersant in 100 to 150 ml of an electrolyte (i.e., 1% NaCl aqueous solution including a first grade sodium chloride such as ISOTON-II from Coulter Electrons Inc.);

(2) 2 to 20 mg of a toner is added to the electrolyte and dispersed using an ultrasonic dispersing machine for about 1 to 3 minutes to prepare a toner suspension liquid;
(3) the volume and number of toner particles in the toner suspension liquid are measured by the above instrument using an aperture of 100 μm; and
(4) the volume average particle diameter (Dv) and the number average particle diameter (Dp) are determined from the volume and number distributions, respectively.

The channels include the following 13 channels: from 2.00 to less than 2.52 μm; from 2.52 to less than 3.17 μm; from 3.17 to less than 4.00 μm; from 4.00 to less than 5.04 μm; from 5.04 to less than 6.35 μm; from 6.35 to less than 8.00 μm; from 8.00 to less than 10.08 μm; from 10.08 to less than 12.70 μm; from 12.70 to less than 16.00 μm; from 16.00 to less than 20.20 μm; from 20.20 to less than 25.40 μm; from 25.40 to less than 32.00 μm; and from 32.00 to less than 40.30 μm. Namely, particles having a particle diameter of from not less than 2.00 μm to less than 40.30 μm can be measured.

The shape of a toner particle can be determined by an optical detection method such that a suspension containing toner particles is passed through an image detector located on a flat plate so that the image of each of the particles is optically detected by a CCD camera and analyzed.

The circularity of a particle is determined by the following equation:

$$\text{Circularity}=Cs/Cp$$

wherein Cp represents the length of the circumference of a projected image of a particle and Cs represents the length of the circumference of a circle having the same area as that of the projected image of the particle.

The average circularity of a toner can be determined using a flow-type particle image analyzer FPIA-2000 manufactured by Sysmex Corp. A typical measurement method is as follows:
(1) 0.1 to 0.5 ml of a surfactant (preferably alkylbenzene sulfonate) is included as a dispersant in 100 to 150 ml of water from which solid impurities have been removed;
(2) 0.1 to 0.5 g of a toner is added thereto and dispersed using an ultrasonic dispersing machine for about 1 to 3 minutes to prepare a toner suspension liquid including 3,000 to 10,000 per 1 micro-liter of the toner particles; and
(3) the average circularity and circularity distribution of the toner are determined by the measuring instrument mentioned above.

Separability from paper of a toner can be evaluated as follows. A toner to which an external additive is added is set in an image forming apparatus IPSIO CX2500 (from Ricoh Co., Ltd.). An unfixed 36 mm-wide band-like solid image including 9 g/m$^2$ of the toner is formed on A4-size paper at a position of 3 mm behind the tip thereof while sheets of the A4-size paper are fed in the vertical direction. The unfixed image is fixed using the after-mentioned fixing device at from 130 to 190° C. in increments of 10° C. to determine a fixable temperature range, in which the toner is well separated from a heating roller and offset does not occur. The paper has a cross direction and a basic weight of 45 g/m$^2$. The fixing device has a peripheral speed of 120 mm/sec. The separability is graded as follows.

A: The fixable temperature range is 50° C. or more.

B: The fixable temperature range is 30° C. or more and less than 50° C.

C: The fixable temperature range is less than 30° C.

Gloss of an image can be evaluated as follows. Yellow, magenta, cyan, and black solid images including 1.0±0.1 mg/cm$^2$ of each toner are formed on a copier paper (TYPE 6000-70W from Ricoh Co., Ltd.). Each of the images thus prepared is fixed when the fixing roller has a surface temperature of 160° C., and the gloss thereof is measured using a gloss meter (from Nippon Denshoku Industries Co., Ltd.) at an incident angle of 60°.

Stress resistance of a toner can be evaluated as follows. A toner to which an external additive is added is set in IPSIO CX2500 (from Ricoh Co., Ltd.) and a print pattern in which a ratio of image portions to non-image portions is 6% is continuously produced on sheets at 23° C. and 45% RH. After 50$^{th}$ and 2,000$^{th}$ sheets are produced, toner particles present on the developing roller are sucked while producing solid image, and the sucked toner particles are subjected to a measurement of the charge amount using an electrometer. An absolute difference between a charge amount measured at 50$^{th}$ sheet and that measured at 2,000$^{th}$ sheets is graded as follows.

A: less than 10 μC/g

B: from 10 to 15 μC/g

C: greater than 15 μC/g

An image forming apparatus according to the present invention forms images with a toner of the present invention. The toner of the present invention may be used for either one-component developers or two-component developers, and preferably used for one-component developers. The image forming apparatus preferably includes a seamless intermediate transfer member. The image forming apparatus preferably includes a photoreceptor and a cleaning device configured to remove residual toner particles remaining on the photoreceptor and/or the intermediate transfer member. The cleaning device may include a cleaning blade. The image forming apparatus preferably includes a fixing device configured to fix an image on a recording medium using a roller or belt containing a heating device. Preferably, a fixing member of the fixing device does not need application of oil. Further, the image forming apparatus may optionally include a neutralization device, a recycle device, a control device, and the like.

The image forming apparatus may include a process cartridge containing a photoreceptor, a developing device, a cleaning device, etc., which is detachably attached thereto. Alternatively, a process cartridge integrally supporting a photoreceptor and at least one of a charger, an irradiator, a developing device, a transfer device, a separation device, and a cleaning device may be detachably attached to an image forming apparatus using a guide member such as a rail.

FIG. 1 is a schematic view illustrating an embodiment of an image forming apparatus according to the present invention. The image forming apparatus illustrated in FIG. 1 includes a casing, not shown, and a latent image bearing member 1 is contained within the casing. Around the latent image bearing member 1, a charger 2, an irradiator 3, a developing device 4 containing a toner T according to the present invention, a cleaning device 5, an intermediate transfer member 6, a support roller 7, a transfer roller 8, and a neutralization device, not shown, are provided.

The image forming apparatus further includes a paper feed cassette, not shown, storing multiple sheets of a recording paper P. Each sheet of the recording paper P is fed by a paper feeding roller and a pair of registration rollers, not shown, to between the transfer roller 8 and the intermediate transfer member 6 in synchronization with an entry of a toner image.

The latent image bearing member 1 rotates clockwise in FIG. 1, and is evenly charged by the charger 2 and irradiated with a laser light beam, which is modulated with image information, emitted from the irradiator 3 so that an electrostatic latent image is formed thereon. The developing device 4 adheres a toner to the electrostatic latent image to form a toner image. The toner image thus formed is then transferred from the latent image bearing member 1 onto the intermediate transfer member 6 to which a transfer bias is applied. The toner image is further transferred from the intermediate transfer member 6 onto the recording paper P which has been fed to between the intermediate transfer member 6 and the transfer roller 8. The recording paper P having the toner image thereon is then fed to a fixing device, not shown.

The fixing device contains a fixing roller equipped with an internal heater, and a pressing roller. The fixing roller is heated to a predetermined temperature by the internal heater and is pressed against the pressing roller at a predetermined pressure. The recording paper P fed from the transfer roller 8 is heated and pressed by the fixing and pressing rollers so that the toner image is fixed on the recording paper P. The recording paper P on which the toner image is fixed is discharged to a paper output tray, not shown.

After transferring the toner image onto the recording paper P, the latent image bearing member 1 further rotates so that the cleaning device 5 removes residual toner particles remaining on a surface of the latent image bearing member 1. The surface of the latent image bearing member 1 is then neutralized by a neutralization device, not shown. The latent image bearing member 1 is evenly charged by the charger 2 again to prepare for the next image formation.

The material, shape, structure, and size of the latent image bearing member 1 are not particularly limited, however, drum-shaped or belt-shaped latent image bearing members are preferable. Specific preferred examples of the latent image bearing member 1 include, but are not limited to, inorganic photoreceptors including amorphous silicon, selenium, etc., and organic photoreceptors including polysilane, phthalopolymethine, etc. Among these photoreceptors, inorganic photoreceptors including amorphous silicon are preferable because of having a long life span.

An electrostatic latent image may be formed by evenly charging a surface of the latent image bearing member 1 and irradiating the charged surface with a light beam containing image information. In the present embodiment, the charger 2 charges a surface of the latent image bearing member 1 and the irradiator 3 irradiates the charged surface with a light beam containing image information. Therefore, the combination of the charger 2 and the irradiator 3 may form an electrostatic latent image forming device.

The charger 2 charges a surface of the latent image bearing member 1 by applying a voltage thereto.

Specific preferred examples of the charger 2 include, but are not limited to, contact chargers containing a conductive or semi-conductive roller, brush, film, rubber blade, or the like, and non-contact chargers using corona discharge such as corotron and scorotron.

The charger 2 may contain a magnetic brush or a fur brush instead of a roller, etc. Suitable magnetic brushes may contain charging members such as ferrites (e.g., Zn—Cu ferrite), a non-magnetic conductive sleeve for supporting the charging members, and a magnet roll fixed inside the non-magnetic conductive sleeve. Suitable fur brushes may be formed by winding or adhering a conductive fur which has been treated with a carbon, copper sulfide, a metal, or a metal oxide to another metal or a conductive cored bar.

The charger 2 is not limited to any particular embodiment. However, contact chargers are preferable for the charger 2 because of generating less ozone.

The irradiator 3 directs a light beam containing image information to a surface of the latent image bearing member 1. Specific preferred examples of the irradiator 3 include, but are not limited to, irradiators using a radiation optical system, a rod lens array, a laser optical system, and a liquid crystal shutter optical system.

The developing device 4 develops an electrostatic latent image with a toner of the present invention. Preferably, the developing device 4 contains a toner of the present invention and supplies the toner to an electrostatic latent image while contacting or without contacting the electrostatic latent image.

The developing device 4 preferably contains a developing roller 40 for supplying a toner to an electrostatic latent image formed on the latent image bearing member 1 by bearing the toner on a peripheral surface thereof while rotating in contact with the latent image bearing member 1, and a thin layer forming member 41 for forming a thin layer of the toner on the developing roller 40 by contacting the peripheral surface of the developing roller 40.

The developing device 4 may employ either a dry developing method or a wet developing method. The developing device 4 may be either a monochrome developing device or a multicolor developing device. A preferred embodiment of the developing device 4 may include an agitator for triboelectrically charging a toner, and a magnetic roller which is rotatable.

Preferably, the developing roller 40 may be a metallic roller or an elastic roller. Specific preferred examples of usable metallic rollers include, but are not limited to, aluminum rollers. Metallic rollers can easily provide the developing roller 40 having a desired surface friction coefficient because surfaces of metallic rollers can be easily blast-treated. For example, an aluminum roller may be blast-treated with glass beads so that the surface thereof is made rough. When the developing roller 40 has such a rough surface, an appropriate amount of toner may be borne thereon.

Specific preferred examples of suitable elastic rollers include rollers covered with, from an innermost side thereof, an elastic rubber layer and a surface covering layer made of a material chargeable to an opposite polarity to toner. The elastic rubber layer preferably has a JIS-A hardness of 60 degrees or less so as to prevent pressure concentration at a contact point with the thin layer forming member 41, which may cause toner deterioration. The elastic rubber layer preferably has a surface roughness (Ra) of from 0.3 to 2.0 μm so that an appropriate amount of toner may be borne on the resultant developing roller 40. The elastic rubber layer preferably has a resistance of from $10^3$ to $10^{10}\Omega$ because a developing bias is applied thereto to form an electric field between the developing roller 40 and the latent image bearing member 1. The developing roller 40 rotates clockwise so that a toner borne on a surface thereon is fed to a position in which the thin layer forming member 41 faces the latent image bearing member 1.

The thin layer forming member 41 is disposed downstream from a contact point of a supply roller 42 with the developing roller 40. The thin layer forming member 41 is made of a metallic spring material such as stainless (SUS) and phosphor bronze, and a free end thereof is in contact with a surface of the developing roller 40 with a pressure of from 10 to 40 N/m. The thin layer forming member 41 forms a thin layer of toner particles passing through the thin layer forming member 41 while triboelectrically charging the toner particles. To facilitate triboelectric charging of toner, a restriction bias, in which the developing bias offsets in the same direction as the charge polarity of toner, is applied to the thin layer forming member 41.

Specific preferred examples of suitable elastic rubbers include, but are not limited to, styrene-butadiene copolymer rubbers, acrylonitrile-butadiene copolymer rubbers, acrylic rubbers, epichlorohydrin rubbers, urethane rubbers, silicone rubbers, and mixtures thereof. Among these rubbers, mixtures of epichlorohydrin rubbers and acrylonitrile-butadiene copolymer rubbers are most preferable.

The developing roller 40 may be formed by covering the peripheral surface of a conductive shaft with an elastic rubber. Suitable conduct shafts may be made of metals such as stainless (SUS).

A transfer device preferably includes a primary transfer unit for transferring a toner image from the latent image bearing member 1 onto the intermediate transfer member 6 and a secondary transfer unit, such as the transfer roller 8, for transferring the toner image from the intermediate transfer member 6 onto the recording paper P. The primary transfer unit preferably transfers multiple-color toner images one by one so that a composite toner image is formed on the intermediate transfer member 6. The secondary transfer unit preferably transfers the composite toner image onto the recording medium P.

Specific preferred embodiments of the intermediate transfer member 6 includes, but are not limited to, transfer belts.

Each of the primary and secondary transfer units preferably contains at least one transfer charger for separating a toner image from the latent image bearing member 1 to a recording paper P side. Specific preferred embodiments of primary and secondary transfer units include, but are not limited to, corona transfer chargers, transfer belts, transfer rollers, pressure transfer rollers, and adhesion transfer units.

Specific preferred embodiments of the recording paper P includes, but are not limited to, plain papers and PET sheets for overhead projector (OHP).

A toner image transferred onto the recording paper P is fixed thereon by a fixing device. Fixing may be performed every time a single toner image is transferred onto the recording medium P or after multiple toner images are superimposed on the recording paper P.

Specific preferred embodiments of the fixing device include, but are not limited to, heating-pressing devices. Heating-pressing device may contain a combination of a heating roller and a pressing roller, a combination of a heating roller, a pressing roller, and an endless belt. Heating-pressing device may have a heating temperature of from 80 to 200° C.

Figure 2:
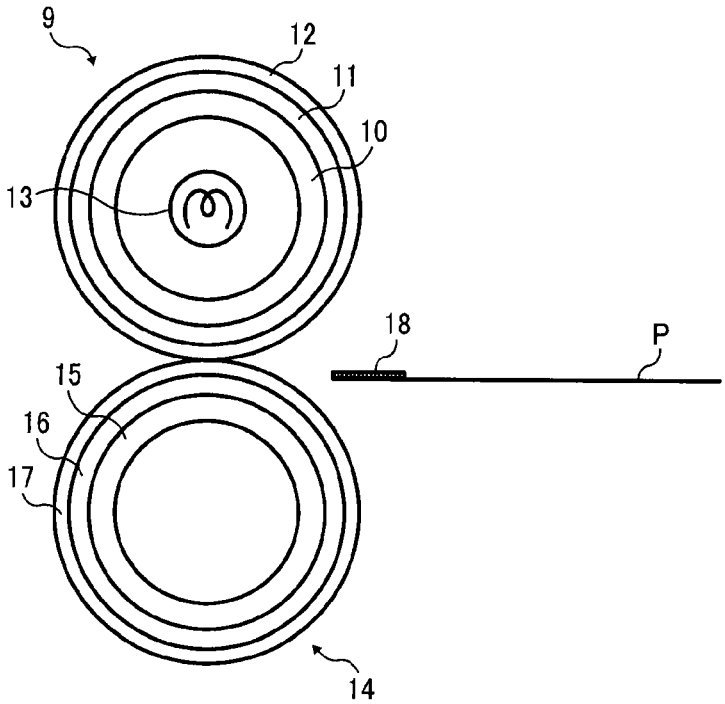
FIG. 2 is a schematic view illustrating an embodiment of a fixing device employing a soft roller covered with a fluorine-based surface layer.

FIG. 2 is a schematic view illustrating an embodiment of a fixing device employing a soft roller covered with a fluorine-based surface layer. A heating roller 9 includes an aluminum cored bar 10, an elastic layer 11 containing a silicone rubber and a surface layer 12 containing PFA (i.e., tetrafluoroethylene-perfluoroalkyl vinyl ether copolymer) each formed on the aluminum cored bar 10, and a heater 13 fixed within the aluminum cored bar 10. A pressing roller 14 includes an aluminum cored bar 15, and an elastic layer 16 containing a silicone rubber and a surface layer 17 containing PFA each formed on the aluminum cored bar 15. A recording paper P having an unfixed toner image 18 thereon is fed to a direction indicated by arrow in FIG. 2.

Such a fixing device may be used in combination with or replaced with an optical fixing device.

A neutralization device neutralizes the latent image bearing member 1 by applying a neutralization bias thereto. Specific preferred embodiments of the neutralization device include, but are not limited to, neutralization lamps.

A cleaning device removes residual toner particles remaining on the latent image bearing member 1. Specific preferred embodiments of the cleaning device include, but are not limited to, magnetic brush cleaners, electrostatic brush cleaners, magnetic roller cleaners, blade cleaners, brush cleaners, and web cleaners.

A recycling device feeds toner particles removed by the cleaning device to the developing device 4. Specific preferred embodiments of the recycling device include, but are not limited to, feeding devices.

A control device controls each devices described above. Specific preferred embodiments of the control device include, but are not limited to, sequencers and computers.

Figure 3:
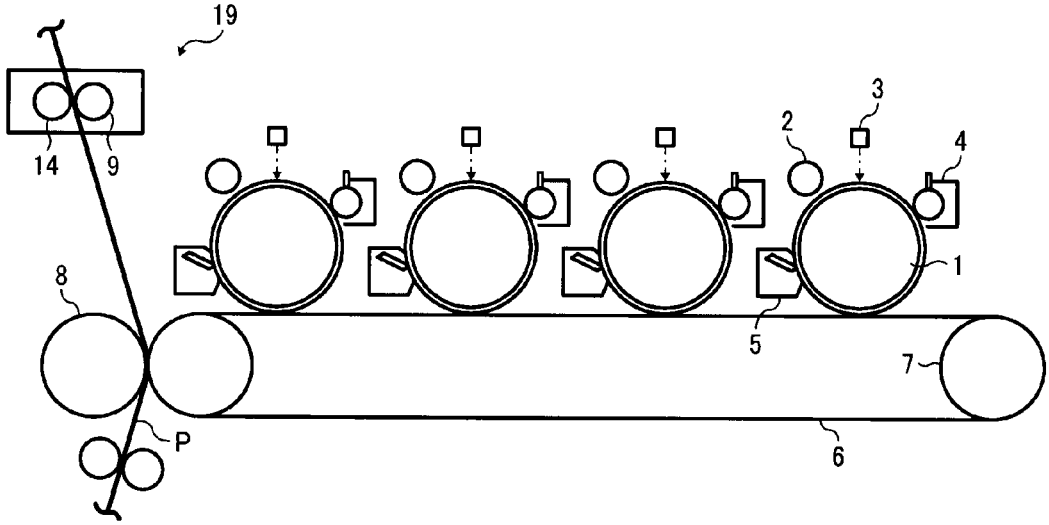
FIG. 3 is a schematic view illustrating an embodiment of a tandem full-color image forming apparatus according to the present invention.

FIG. 3 is a schematic view illustrating an embodiment of a tandem full-color image forming apparatus according to the present invention.

An image forming apparatus illustrated in FIG. 3 includes four image forming units having the same configuration except for containing different color toners. Each image forming unit includes a casing, not shown, within which a latent image bearing member 1 is contained. The latent image bearing member 1 is driven to rotate clockwise. Around the latent image bearing member 1, a charger 2, an irradiator 3, a developing device 4, an intermediate transfer member 6, a support roller 7, and a transfer roller 8 are disposed. The image forming apparatus further includes a paper feed cassette, not shown, storing multiple sheets of a recording paper P. Each sheet of the recording paper P is fed by a paper feeding roller and a pair of registration rollers, not shown, to between the transfer roller 8 and the intermediate transfer member 6 in synchronization with an entry of a toner image. A toner image is then fixed on the recording paper P in a fixing device 19.

The latent image bearing member 1 rotates clockwise in FIG. 3, and is evenly charged by the charger 2 and irradiated with a laser light beam, which is modulated with image information, emitted from the irradiator 3 so that an electrostatic latent image is formed thereon. The developing device 4 adheres a toner to the electrostatic latent image to form a toner image. The toner image thus formed is then transferred from the latent image bearing member 1 onto the intermediate transfer member 6. These processes are performed in each image forming units so that cyan, magenta, yellow, and black toner images are formed.

Figure 4:
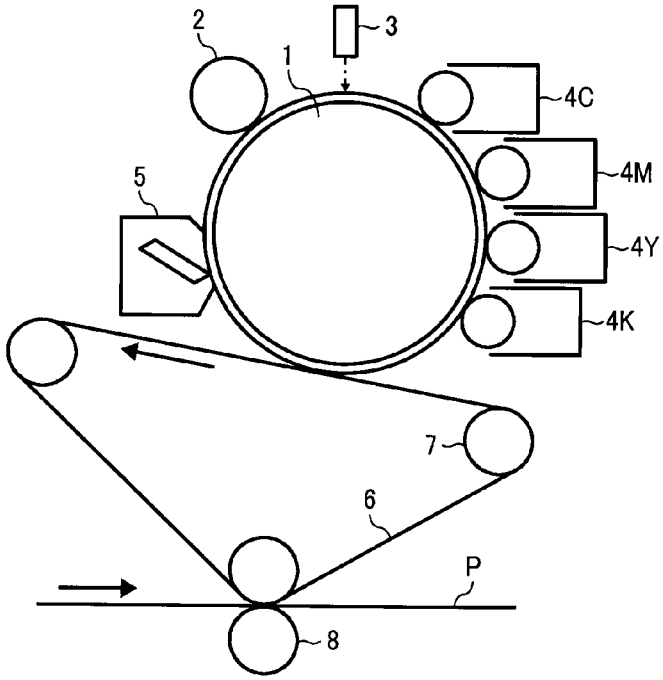
FIG. 4 is a schematic view illustrating an embodiment of a revolver-type full-color image forming apparatus according to the present invention.

FIG. 4 is a schematic view illustrating an embodiment of a revolver-type full-color image forming apparatus according to the present invention. In the revolver-type full-color image forming apparatus, multiple different-color toner images are sequentially formed on the latent image bearing member 1, which is single, by switching operations of multiple developing devices. A full-color toner image formed on an intermediate transfer member 6 is transferred onto a recording paper P. The recording paper P having the full-color toner image thereon is then fed to a fixing device, not shown.

After transferring the full-color toner image from the intermediate transfer member 6 onto the recording paper P, the latent image bearing member 1 further rotates so that residual toner particles remaining on a surface of the latent image bearing member 1 are removed by a blade in a cleaning device 5. The surface of the latent image bearing member 1 is then neutralized by a neutralization device, not shown. The latent image bearing member 1 is evenly charged by a charger 2 again to prepare for the next image formation. The cleaning device 5 may employ a fur brush instead of the blade.

A process cartridge according to the present invention includes a latent image bearing member configured to bear an electrostatic latent image and a developing device configured to develop the electrostatic latent image with a toner of the present invention to form a toner image. Optionally, the process cartridge may include a charger, a transfer device, a cleaning device, and a neutralization device, and the like. The process cartridge is detachably attachable to image forming apparatuses.

The developing device includes a developer container containing a toner or developer of the present invention and a developer bearing member for bearing and feeding the toner or developer contained in the developer container. Optionally, the developing device may include a thickness control member for controlling the thickness of a toner layer borne on the developer bearing member. The process cartridge of the present invention may be detachably attachable to electrophotographic apparatuses, facsimile machines, printers, and image forming apparatuses of the present invention.

Figure 5:
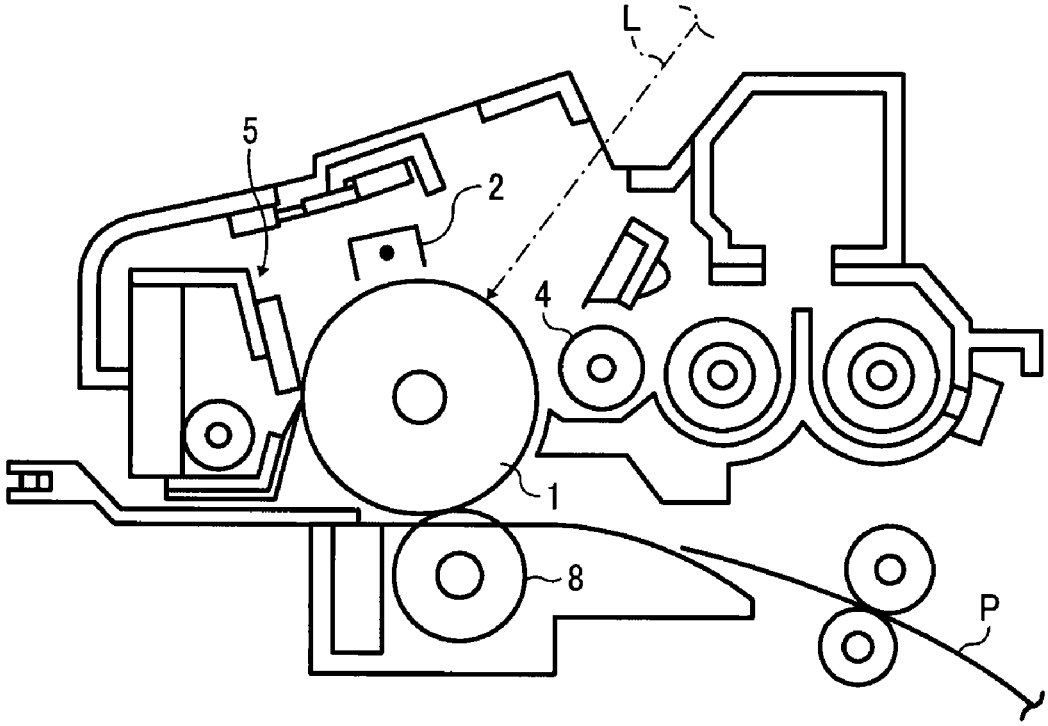
FIG. 5 is a schematic view illustrating an embodiment of a process cartridge according to the present invention.

FIG. 5 is a schematic view illustrating an embodiment of a process cartridge according to the present invention. The process cartridge illustrated in FIG. 5 contains a latent image bearing member 1, a charger 2, a developing device 4, a transfer roller 8, and a cleaning device 5.

The latent image bearing member 1 rotates clockwise in FIG. 5, and is evenly charged by the charger 2 and irradiated with a laser light beam L containing image information emitted from an irradiator, not shown, so that an electrostatic latent image is formed thereon. The developing device 4 adheres a toner to the electrostatic latent image to form a toner image. The toner image thus formed is then transferred from the latent image bearing member 1 onto a recording paper P by the transfer roller 8. After transferring the toner image, a surface of the latent image bearing member 1 is cleaned by the cleaning device 5 and neutralized by a neutralization device, not shown, so as to prepare for the next image forming.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Preparation of Encapsulated Plasticizers (Synthesis of Polyester (1))

A reaction vessel equipped with a condenser, a stirrer, and a nitrogen inlet pipe is charged with 553 parts of ethylene oxide 2 mol adduct of bisphenol A, 196 parts of propylene oxide 2 mol adduct of bisphenol A, 220 parts of terephthalic acid, 45 parts of adipic acid, and 2 parts of dibutyltin oxide. The mixture is reacted for 8 hours at 230° C. at normal pressures, and subsequently for 5 hours under reduced pressures of from 10 to 15 mmHg. Further, 46 parts of trimellitic anhydride are added to the reaction vessel and the mixture is reacted for 2 hours at 180° C. at normal pressures. Thus, a polyester (1) is prepared. The polyester (1) has a number average molecular weight of 2,200, a weight average molecular weight of 5,600, a glass transition temperature (Tg) of 43° C., and an acid value of 13 mgKOH/g.

(Synthesis of Prepolymer)

A reaction vessel equipped with a condenser, a stirrer, and a nitrogen inlet pipe is charged with 682 parts of ethylene oxide 2 mol adduct of bisphenol A, 81 parts of propylene oxide 2 mol adduct of bisphenol A, 283 parts of terephthalic acid, 22 parts of trimellitic anhydride, and 2 parts of dibutyltin oxide. The mixture is reacted for 8 hours at 230° C. at normal pressures, and subsequently for 5 hours under reduced pressures of from 10 to 15 mmHg. Thus an intermediate polyester (1) is prepared. The intermediate polyester (1) has a number average molecular weight of 2,100, a weight average molecular weight of 9,500, a glass transition temperature (Tg) of 55° C., an acid value of 0.5 mgKOH/g, and a hydroxyl value of 49 mgKOH/g.

Next, another reaction vessel equipped with a condenser, a stirrer, and a nitrogen inlet pipe is charged with 411 parts of the intermediate polyester (1), 89 parts of isophorone diisocyanate, and 500 parts of ethyl acetate. The mixture is reacted for 5 hours at 100° C. Thus, a prepolymer (1) is prepared. The prepolymer (1) includes free isocyanates in an amount of 1.53% by weight.

(Preparation of Master Batch)

First, 50 parts of stearamide (i.e., a plasticizer), 50 parts of a polyester resin (RS-801 from Sanyo Chemical Industries, Ltd., having an acid value of 10 mgKOH/g, a weight average molecular weight (Mw) of 20,000, and a glass transition temperature (Tg) of 64° C.), and 30 parts of water are mixed using a HENSCHEL MIXER, resulting in a mixture in which water is penetrated into plasticizer aggregations. The mixture is kneaded for 45 minutes using a double-roll mill with setting the surface temperatures of the rolls to 130° C. The kneaded mixture is pulverized into particles with a diameter of 1 mm using a pulverizer. Thus, a master batch (1) is prepared.

(Preparation of Plasticizer Dispersion)

A vessel equipped with a stirrer is charged with 400 parts of the polyester (1), 818 parts of the master batch (1), and 996 parts of ethyl acetate, and the mixture is stirred for 1 hour. Thus, a plasticizer dispersion (1) is prepared.

(Preparation of Aqueous Medium)

To prepare an aqueous medium, 941 parts of ion-exchange water, 95 parts of a 25% by weight aqueous dispersion of an organic particulate resin (a copolymer of styrene, methacrylic acid, butyl acrylate, and a sodium salt of sulfate ester of ethylene oxide adduct of methacrylic acid), 95 parts of a 48.5% aqueous solution of dodecyl diphenyl ether sodium disulfonate (ELEMINOL MON-7 from Sanyo Chemical Industries, Ltd.), and 113 parts of ethyl acetate are mixed. Thus, an aqueous medium (1), which is a milky liquid, is prepared.

(Emulsification)

First, 980 parts of the plasticizer dispersion (1) and 12 parts of isophoronediamine are mixed for 1 minute using a TK HOMOMIXER (from PRIMIX Corporation) at a revolution of 5,000 rpm. The mixture is poured into 1,200 parts of the aqueous medium (1) and agitated using a TK HOMOMIXER at a revolution of from 8,000 to 13,000 rpm for 20 minutes. Thus, an emulsion slurry (1) containing the plasticizer in an amount of 30% by weight is prepared.

(Solvent Removal)

The emulsion slurry (1) is poured into a vessel equipped with a stirrer and a thermometer and subjected to a solvent removal for 8 hours at 30° C. Thus, a dispersion slurry (1) is prepared.

(Washing and Drying)

Next, 100 parts of the dispersion slurry (1) is filtered under reduced pressures to obtain a wet cake.

The wet cake thus obtained is mixed with 100 parts of ion-exchange water and the mixture is agitated for 10 minutes using a TK HOMOMIXER at a revolution of 12,000 rpm, followed by filtering. Thus, a wet cake (i) is prepared.

The wet cake (i) is mixed with 900 parts if ion-exchange water and the mixture id agitated for 30 minutes using a TK HOMOMIXER at a revolution of 12,000 rpm while applying ultrasonic vibration, followed by filtering under reduced pressures. This operation is repeated until the re-slurry liquid has an electric conductivity of 10 μC/cm or less. Thus, a wet cake (ii) is prepared.

The wet cake (ii) is mixed with a 10% aqueous solution of hydrochloric acid so that the re-slurry liquid has a pH of 4. The mixture is agitated for 30 minutes using three-one motor. Thus, a wet cake (iii) is prepared.

The wet cake (iii) is mixed with 100 parts of ion-exchange water and the mixture is agitated for 10 minutes using a TK HOMOMIXER at a revolution of 12,000 rpm, followed by filtering. This operation is repeated until the re-slurry liquid has an electric conductivity of 10 μC/cm or less. Thus, a wet cake (iv) is prepared.

The wet cake (iv) is dried for 48 hours at 45° C. using a circulating air drier, followed by sieving with a screen having openings of 75 μm. Thus, an encapsulated plasticizer (1) is prepared. The encapsulated plasticizer (1) has a weight average particle diameter of 0.6 μm, measured by a particle size distribution analyzer LA-920 from Horiba, Ltd.

The procedure for preparing the encapsulated plasticizer (1) is repeated except that the amount of isophoronediamine added in the emulsification is changed to 10 parts. Thus, an encapsulated plasticizer (2) is prepared. The encapsulated plasticizer (2) has a weight average particle diameter of 1.3 μm.

Preparation of Colorant Master Batch

First, 40 parts of a carbon black (REGAL® 400R from Cabot Corporation), 60 parts of a polyester resin (RS-801 from Sanyo Chemical Industries, Ltd., having an acid value of 10 mgKOH/g, a weight average molecular weight (Mw) of 20,000, and a glass transition temperature (Tg) of 64° C.), and 30 parts of water are mixed using a HENSCHEL MIXER, resulting in a mixture in which water is penetrated into pigment aggregations. The mixture is kneaded for 45 minutes using a double-roll mill with setting the surface temperatures of the rolls to 130° C. The kneaded mixture is pulverized into particles with a diameter of 1 mm using a pulverizer. Thus, a master batch (2) is prepared.

Example 1

(Preparation of Colorant-Wax Dispersion)

A vessel equipped with a stirrer and a thermometer is charged with 378 parts of the polyester (1), 120 parts of a paraffin wax (HNP9), and 1,450 parts of ethyl acetate. The mixture is heated to 80° C. for 5 hours while being agitated, and subsequently cooled to 30° C. over a period of 1 hour. Further, 500 parts of the master batch (2) and 500 parts of ethyl acetate are added to the vessel and mixed for 1 hour. Thus, a raw material liquid (1) is prepared.

Next, 1,500 parts of the raw material liquid (1) are subjected to a dispersion treatment using a bead mill (ULTRAVISCOMILL (trademark) from Aimex Co., Ltd.). The dispersing conditions are as follows.

Liquid feeding speed: 1 kg/hour

Peripheral speed of disc: 6 m/sec

Dispersion media: zirconia beads with a diameter of 0.5 mm

Filling factor of beads: 80% by volume

Repeat number of dispersing operation: 3 times (3 passes)

Further, 655 parts of a 65% ethyl acetate solution of the polyester (1) is added thereto and the mixture is subjected to the above dispersion treatment again for once (1 pass). Thus, a colorant-wax dispersion (1) is prepared. The colorant-wax dispersion (1) is diluted with ethyl acetate so that the concentration of solid components becomes 50%.

(Preparation of Aqueous Medium)

To prepare an aqueous medium, 953 parts of ion-exchange water, 88 parts of a 25% aqueous dispersion of an organic particulate resin (a copolymer of styrene, methacrylic acid, butyl acrylate, and sodium salt of sulfate ester of ethylene oxide adduct of methacrylic acid), 90 parts of a 48.5% aqueous solution of dodecyl diphenyl ether sodium disulfonate (ELEMINOL MON-7 from Sanyo Chemical Industries, Ltd.), and 113 parts of ethyl acetate are mixed. Thus, an aqueous medium (2), which is a milky liquid, is prepared.

(Emulsification)

First, 967 parts of the colorant-wax dispersion (1), the encapsulated plasticizer (1), and 5 parts of isophoronediamine are mixed for 1 minute using TK HOMOMIXER (from PRIMIX Corporation) at a revolution of 5,000 rpm, so that the concentration of the encapsulated plasticizer (2) becomes 10% on solid basis. Next, 137 parts of the prepolymer (1) is further added and mixed for 1 minute using TK HOMOMIXER (from PRIMIX Corporation) at a revolution of 5,000 rpm. The resultant mixture is poured into 1,200 parts of the aqueous medium (2) and is agitated by TK HOMOMIXER at a revolution of from 8,000 to 13,000 rpm for 20 minutes. Thus, an emulsion slurry (2) is prepared.

(Solvent Removal)

The emulsion slurry (2) is poured into a vessel equipped with a stirrer and a thermometer and subjected to a solvent removal for 8 hours at 30° C. Thus, a dispersion slurry (2) is prepared.

(Washing and Drying)

Next, 100 parts of the dispersion slurry (2) is filtered under reduced pressures to obtain a wet cake.

The wet cake thus obtained is mixed with 100 parts of ion-exchange water and the mixture is agitated for 10 minutes using a TK HOMOMIXER at a revolution of 12,000 rpm, followed by filtering. Thus, a wet cake (i) is prepared.

The wet cake (i) is mixed with 900 parts of ion-exchange water and the mixture is agitated for 30 minutes using a TK HOMOMIXER at a revolution of 12,000 rpm while applying ultrasonic vibration, followed by filtering under reduced pressures. This operation is repeated until the re-slurry liquid has an electric conductivity of 10 μC/cm or less. Thus, a wet cake (ii) is prepared.

The wet cake (ii) is mixed with a 10% aqueous solution of hydrochloric acid so that the re-slurry liquid has a pH is 4. The mixture is agitated for 30 minutes using three-one motor. Thus, a wet cake (iii) is prepared.

The wet cake (iii) is mixed with 100 parts of ion-exchange water and the mixture is agitated for 10 minutes using a TK HOMOMIXER at a revolution of 12,000 rpm, followed by filtering. This operation is repeated until the re-slurry liquid has an electric conductivity of 10 μC/cm or less. Thus, a wet cake (iv) is prepared.

The wet cake (iv) is dried for 48 hours at 45° C. using a circulating air drier, followed by sieving with a screen having openings of 75 μm. Thus, a mother toner (1) is prepared. The mother toner (1) has a volume average particle diameter (Dv) of 7.3 μm, a number average particle diameter (Dp) of 6.4 μm, a ratio Dv/Dp of 1.14, and an average circularity of 0.971.

Next, 100 parts of the mother toner (1) and 0.5 part of a hydrophobized silica are mixed using a HENSCHEL MIXER. Thus, a toner (1) is prepared.

Examples 2 to 3

The procedure for preparation of the toner (1) in Example 1 is repeated except that the amount of the encapsulated plasticizer (1) is changed as described in Table 1. Thus, toners (2) and (3) are prepared.

Example 4

The procedure for preparation of the toner (1) in Example 1 is repeated except that the encapsulated plasticizer (1) is replaced with the encapsulated plasticizer (2). Thus, a toner (4) is prepared.

Example 5

The procedure for preparation of the toner (1) in Example 1 is repeated except that the amounts of the plasticizer dispersion (1), isophorone diamine, and the prepolymer (1) are changed to 980 parts, 9 parts, and 96 parts, respectively, in the emulsification process. Thus, a toner (5) is prepared.

In the toner (5), the resin covering the plasticizer may melt more easily that the binder resin.

Comparative Example 1

The procedure for preparation of the toner (1) in Example 1 is repeated except that the encapsulated plasticizer (1) is not added. Thus, a comparative toner (1) is prepared.

Comparative Example 2

The procedure for preparation of the toner (1) in Example 1 is repeated except that the encapsulated plasticizer (1) is replaced with bare stearamide which is not encapsulated. Thus, a comparative toner (2) is prepared.

Comparative Example 3

To prepare a colorant-wax dispersion, 60 parts of the polyester (1), 5 parts of a paraffin wax, 80 parts of ethyl acetate, 10 parts of stearamide, and 5 parts of a carbon black are mixed using a TK HOMOMIXER.

Next, 397 g of the colorant-wax dispersion is heated to 50° C., and 7.5 g of the prepolymer (1) are added thereto. On the other hand, 1,400 g of a 0.75% PVA solution is heated to 50° C., and a mixture of the colorant-wax dispersion and an isocyanate is emulsified therein using an ultra homogenizer so that an emulsion containing droplets with a diameter of from 5 to 25 μm is formed. The emulsion is further mixed with 121 g of water and 5.7 g of diethylene triamine, and the mixture is subjected to an encapsulating reaction for 10 hours at room temperatures. Thus, a dispersion slurry (3) is prepared.

The dispersion slurry (3) is subjected to the same washing and drying processes as Example 1. Thus, a comparative toner (3) is prepared.

The compositions of the toners prepared above are shown in Table 1. The evaluation results of the toners prepared above are shown in Table 2.

TABLE 1

| | Plasticizer | | | |
|---|---|---|---|---|
| | Chemical Structure | Encapsulated? | Average Diameter Dn (μm) | Amount (% based on toner) |
| Example 1 | Stearamide | Yes | 0.6 | 3 |
| Example 2 | Stearamide | Yes | 0.6 | 1 |
| Example 3 | Stearamide | Yes | 0.6 | 5 |
| Example 4 | Stearamide | Yes | 1.3 | 3 |
| Example 5 | Stearamide | Yes | 0.6 | 3 |
| Comparative Example 1 | | — | — | 0 |
| Comparative Example 2 | Stearamide | No | 0.4 | 3 |
| Comparative Example 3 | Stearamide | Toner is encapsulated. | 0.4 | 3 |

TABLE 2

| | Gloss | Separability | Stress Resistance |
|---|---|---|---|
| Example 1 | 15 | A | A |
| Example 2 | 10 | A | A |
| Example 3 | 18 | A | A |
| Example 4 | 12 | A | A |
| Example 5 | 21 | A | A |
| Comparative Example 1 | 2 | A | A |
| Comparative Example 2 | 14 | A | C |
| Comparative Example 3 | 7 | A | B |

This document claims priority and contains subject matter related to Japanese Patent Application No. 2008-141879, filed on May 30, 2008, the entire contents of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner manufactured by a method comprising;

dissolving or dispersing toner components comprising a binder resin, a colorant, and an encapsulated plasticizer to prepare an oily toner components liquid; and emulsifying or dispersing the oily toner components liquid in an aqueous medium to prepare the toner.

2. The toner according to claim 1, wherein the plasticizer is encapsulated with a resin which melts more easily than the binder resin when the toner is fixed on a recording medium.

3. The toner according to claim 1, wherein the binder resin comprises a modified polyester resin.

4. The toner according to claim 3, wherein the modified polyester resin has at least one of urethane group and urea group.

5. The toner according to claim 1, wherein the binder resin comprises a resin formed from a reaction between a polyester resin having a terminal isocyanate group with an amine.

6. A one-component developer, comprising the toner according to claim 1 and no magnetic carrier.

7. A two-component developer, comprising the toner according to claim 1 and a magnetic carrier.

8. A toner container, comprising the toner according to claim 1.

9. A process cartridge, comprising:

an electrostatic latent image bearing member configured to bear an electrostatic latent image; and a developing device configured to develop the electrostatic latent image with the toner according to claim 1 to form a toner image.

10. An image forming apparatus, comprising:

an electrostatic latent image bearing member configured to bear an electrostatic latent image;

an electrostatic latent image forming device configured to form an electrostatic latent image on the electrostatic latent image bearing member;

a developing device configured to develop the electrostatic latent image with the toner according to claim 1 to form a toner image;

a transfer device configured to transfer the toner image onto a recording medium; and a fixing device configured to fix the toner image on the recording medium.

11. The image forming apparatus according to claim 10, wherein the plasticizer is encapsulated with a resin which melts more easily than the binder resin when the toner is fixed on a recording medium.

12. The image forming apparatus according to claim 10, wherein the binder resin comprises a modified polyester resin.

13. The image forming apparatus according to claim 12, wherein the modified polyester resin has at least one of urethane group and urea group.

14. The image forming apparatus according to claim 10, wherein the binder resin comprises a resin formed from a reaction between a polyester resin having a terminal isocyanate group with an amine.

15. An image forming method, comprising:

forming an electrostatic latent image on an electrostatic latent image bearing member;

developing the electrostatic latent image with the toner according to claim 1 to form a toner image;

transferring the toner image onto a recording medium; and fixing the toner image on the recording medium.

16. The image forming method according to claim 15, wherein the plasticizer is encapsulated with a resin which melts more easily than the binder resin when the toner is fixed on a recording medium.

17. The image forming method according to claim 15, wherein the binder resin comprises a modified polyester resin.

18. The image forming method according to claim 17, wherein the modified polyester resin has at least one of urethane group and urea group.

19. The image forming method according to claim 15, wherein the binder resin comprises a resin formed from a reaction between a polyester resin having a terminal isocyanate group with an amine.

* * * * *